US010900663B2

(12) United States Patent
Bertelli

(10) Patent No.: US 10,900,663 B2
(45) Date of Patent: Jan. 26, 2021

(54) DEVICE FOR CONTROLLING A FUEL-OXIDIZER MIXTURE FOR PREMIX GAS BURNERS

(71) Applicant: BERTELLI & PARTNERS S.R.L., Angiari (IT)

(72) Inventor: Pierluigi Bertelli, Bardolino (IT)

(73) Assignee: BERTELLI & PARTNERS S.R.L., Verona (IT)

( * ) Notice: Subject to any disclaimer, the term of this patent is extended or adjusted under 35 U.S.C. 154(b) by 46 days.

(21) Appl. No.: 16/296,770

(22) Filed: Mar. 8, 2019

(65) Prior Publication Data

US 2019/0285275 A1 Sep. 19, 2019

(30) Foreign Application Priority Data

Mar. 13, 2018 (IT) ..... 102018000003488

(51) Int. Cl.

| | |
|---|---|
| ***F23N 1/02*** | (2006.01) |
| ***F23D 14/02*** | (2006.01) |
| ***F23D 14/60*** | (2006.01) |
| ***F23N 5/00*** | (2006.01) |
| ***F23N 5/18*** | (2006.01) |
| ***F23N 3/08*** | (2006.01) |
| ***F23N 5/02*** | (2006.01) |

(52) U.S. Cl.

CPC ..... *F23N 1/025* (2013.01); *F23D 14/02* (2013.01); *F23D 14/60* (2013.01); *F23N 1/022* (2013.01); *F23N 3/08* (2013.01); *F23N 5/003* (2013.01); *F23N 5/022* (2013.01); *F23N 5/187* (2013.01); *F23N 2005/181* (2013.01)

(58) Field of Classification Search

CPC ..... F23N 1/047; F23N 1/027; F23D 14/62; F23D 14/60; F23D 14/08

USPC ..... 431/89, 62, 354, 239, 193, 18

See application file for complete search history.

(56) References Cited

U.S. PATENT DOCUMENTS

| | | | | |
|---|---|---|---|---|
| 2,116,911 A * | 5/1938 | Richardson | F23L 1/02 | 110/188 |
| 6,604,938 B1 * | 8/2003 | Blaauwwiekel | F23D 14/04 | 431/18 |
| 2011/0139045 A1 * | 6/2011 | Zatti | F23D 14/60 | 110/188 |

FOREIGN PATENT DOCUMENTS

| | | |
|---|---|---|
| CA | 2 371 188 A1 | 12/2000 |
| DE | 196 35 974 A1 | 3/1998 |

(Continued)

OTHER PUBLICATIONS

Search Report from IT Application No. 201800003488 having completion date of Oct. 30, 2018 (7 pgs).

*Primary Examiner* — Vivek K Shirsat

(74) *Attorney, Agent, or Firm* — Wentsler LLC

(57) ABSTRACT

Described is a device for controlling a fuel-oxidizer mixture for a premix gas burner, comprising an intake duct, which defines a cross section for the passage of a fluid inside the duct and includes an inlet, a mixing zone and an outlet, an injection duct, connected to the intake duct in the mixing zone, a monitoring device, configured for generating a control signal, representing a combustion state in the burner, a gas regulating valve, positioned along the injection duct, a fan, positioned in the intake duct for generating therein an operating flow in an inflow direction, a control unit, configured to control the rotation speed of the fan, a regulator, coupled with the intake duct for varying the cross section. The control unit is configured for controlling the gas regulating valve in real time.

19 Claims, 11 Drawing Sheets

(56) References Cited

FOREIGN PATENT DOCUMENTS

| | | | |
|---|---|---|---|
| EP | 0 559 280 | A1 | 9/1993 |
| FR | 2628511 | A1 | 9/1989 |
| RU | 2318160 | C1 | 2/2008 |
| RU | 2442078 | C1 | 2/2012 |
| WO | 2009/133451 | A2 | 11/2009 |
| WO | 2012/007823 | A1 | 1/2012 |

* cited by examiner

DEVICE FOR CONTROLLING A FUEL-OXIDIZER MIXTURE FOR PREMIX GAS BURNERS

BACKGROUND OF THE INVENTION

1. Field of the Invention

This invention relates to a device for controlling a fuel-oxidizer mixture for premix gas burners.

2. Description of Related Art

In the technical sector of control devices for premix burners there are control devices characterised by an architecture wherein the fan is an active element, the so-called "driver", whilst the gas valve is a passive element, the so-called "follower". In these architectures of control devices the of gas flow rate is determined by the difference between the pressure upstream of the mixing system and the pressure downstream of the mixing system. More specifically, the gas flow rate is a function of the difference between the pressure at the inlet to the Venturi and the pressure in the minimum cross section of the Venturi. In fact, the gas valve, regardless of the pressure of the gas at the inlet (network pressure), sends gas at the same pressure as the air entering the Venturi.

These devices also have a manual flow rate regulator located on the injection duct between the gas valve and the mixing zone for regulating, before the ignition, the correct air/gas ratio. When the burner is switched on, the air/gas ratio remains equal and the negative pressure increases by the square of the air flow rate.

These flow rate regulators are not, however, very precise and this translates into air/gas ratios which are sometimes very different from the ideal ones.

These devices also have the drawback of having, for very extensive operating ranges (thermal power, flow rate), operating pressures (measured as the difference between the inlet and the outlet of the fan) at low operating flow rates comparable to the declared error of the gas valve +−5/10 Pa. Since this operating condition is not acceptable, these control devices are only suitable for limited operating ranges. On the other hand, for very high flow rates the head losses are very high, the revolutions of the fan are very high and the noise is excessive.

Documents WO2009133451A2 and WO2012007823A1 describe a device for controlling the air/gas mixture in which the intake duct, downstream of the mixing zone, is divided into two channels separated by a partition. A channel is closed by a shutter hinged to the partition.

This solution makes it possible to use a single channel at the low flow rates, increasing the operating pressure for increasing air speed. Moreover, with the increase in the flow rate and the thrust generated by it, the shutter opens increasing the passage cross section. This results in a reduction of the speed of the mixture and consequently a reduction in the operating pressure.

However, this solution does not modify the characteristics of the mixing system (Venturi) so with the increase in the flow rate the head losses continue to increase, even though at a smaller rate of increase.

For this reason, there is a direct proportionality between the number of channels and the working range permitted by the burner. Is therefore evident that the increase in the flexibility of the burner results in a disadvantageous increase in the constructional complexity.

These devices, characterised by a hinged shutter, are also more subject to problems of shutter blockages with a consequent increase in the maintenance activities.

Document CA2371188 describes a device for controlling the mixture substantially of the same type as those described in WO2009133451A2 WO2012007823A1 in which, however, the opening of the shutter is also regulated through a spring.

BRIEF SUMMARY OF THE INVENTION

The mixture control devices are devices designed for controlling the fuel-oxidizer mixture ratio and for controlling the flow rate of the fuel-oxidizer mixture. In premix gas burners the fuel is gas and the oxidizer is air. The burners are referred to as premix since the mixing of air and gas occurs before entering the combustion head.

The device for controlling the mixture comprises an air intake duct from which air is picked up and an injection duct through the gas is provided. The injection duct is open on the intake duct in a mixing zone. In the injection duct there is also a gas valve for controlling the gas flow rate. The device comprises a fan for feeding the of air and gas mixture into a combustion head. Moreover, the device comprises a mixing system which generates a negative pressure in the mixing zone. The mixing system determines the negative pressure to which the air passing through is subjected to and hence the pressure in the mixing zone. For this reason, the negative pressure also determines the injection pressure of the gas in the mixing zone.

The premix gas burners must operate within a very large range of thermal flow rates and with reduced energy consumption, in line with the increasingly high performance levels required by the users.

In the technical sector of control devices for premix burners there are control devices characterised by an architecture wherein the fan is an active element, the so-called "driver", whilst the gas valve is a passive element, the so-called "follower". In these architectures of control devices the of gas flow rate is determined by the difference between the pressure upstream of the mixing system and the pressure downstream of the mixing system. More specifically, the gas flow rate is a function of the difference between the pressure at the inlet to the Venturi and the pressure in the minimum cross section of the Venturi. In fact, the gas valve, regardless of the pressure of the gas at the inlet (network pressure), sends gas at the same pressure as the air entering the Venturi.

These devices also have a manual flow rate regulator located on the injection duct between the gas valve and the mixing zone for regulating, before the ignition, the correct air/gas ratio. When the burner is switched on, the air/gas ratio remains equal and the negative pressure increases by the square of the air flow rate.

These flow rate regulators are not, however, very precise and this translates into air/gas ratios which are sometimes very different from the ideal ones.

These devices also have the drawback of having, for very extensive operating ranges (thermal power, flow rate), operating pressures (measured as the difference between the inlet and the outlet of the fan) at low operating flow rates comparable to the declared error of the gas valve +−5/10 Pa. Since this operating condition is not acceptable, these control devices are only suitable for limited operating ranges. On the other hand, for very high flow rates the head losses are very high, the revolutions of the fan are very high and the noise is excessive.

Documents WO2009133451A2 and WO2012007823A1 describe a device for controlling the air/gas mixture in which the intake duct, downstream of the mixing zone, is divided into two channels separated by a partition. A channel is closed by a shutter hinged to the partition.

This solution makes it possible to use a single channel at the low flow rates, increasing the operating pressure for increasing air speed. Moreover, with the increase in the flow rate and the thrust generated by it, the shutter opens increasing the passage cross section. This results in a reduction of the speed of the mixture and consequently a reduction in the operating pressure.

However, this solution does not modify the characteristics of the mixing system (Venturi) so with the increase in the flow rate the head losses continue to increase, even though at a smaller rate of increase.

For this reason, there is a direct proportionality between the number of channels and the working range permitted by the burner. Is therefore evident that the increase in the flexibility of the burner results in a disadvantageous increase in the constructional complexity.

These devices, characterised by a hinged shutter, are also more subject to problems of shutter blockages with a consequent increase in the maintenance activities.

Document CA2371188 describes a device for controlling the mixture substantially of the same type as those described in WO2009133451A2 WO2012007823A1 in which, however, the opening of the shutter is also regulated through a spring.

One aim of the present technology is to provide a device for controlling the mixture the fuel-oxidizer mixture which overcomes the above-mentioned drawbacks.

This aim can be fully achieved by the device according to the invention as characterised in the appended claims.

According to an aspect, the present technology protects a device for controlling the fuel-oxidizer mixture for premix gas burners.

The device comprises an intake duct. The intake duct comprises an inlet, for receiving the oxidizer.

The intake duct comprises a mixing zone, for receiving the fuel. The mixing zone is configured to allow the mixing of the fuel with the oxidizer. The intake duct comprises an outlet, to make available the mixture. For clarity in the subsequent description, the term "mixing pressure" is used to mean the pressure which governs inside the mixing zone. For clarity in the subsequent description, the term "operating pressure" is used to mean the head provided by the fan, that is to say, the difference between the pressure at the fan inlet and the pressure at the fan outlet.

The device comprises an injection duct. The injection duct is connected to the intake duct in the mixing zone, for delivering the fuel.

According to an embodiment, the device comprises a display for monitoring the combustion. The monitoring device is configured to send control signals, representing the state of combustion in the premix gas burner.

The device comprises a control unit. The device comprises a user interface. The control unit is configured for generating control signals. According to an embodiment, the control signals depend on the control signals sent by the monitoring device. According to an embodiment, the control signals depend on input data, entered by a user through the user interface.

According to an embodiment, the device comprises a first regulator. According to an embodiment, the first regulator is positioned along the injection duct. According to an embodiment, the first regulator is connected to the control unit. According to an embodiment, the first regulator is connected by the control unit. According to an embodiment, it is configured to vary a flow rate of the fuel as a function of control signals sent by the control unit. According to an embodiment, the control signals for controlling the first regulator are dependent on the control signals the sent to the control unit by the monitoring device. According to an embodiment, the first regulator is an electrically-controlled solenoid valve.

According to an embodiment, the first regulator may also be a mechanically-controlled regulator, that is, dependent on a variation of a mechanical parameter such as, for example (but not necessarily), a pressure or a force. According to another embodiment, the first regulator is a mixed regulator, which couples a regulation system using control signals (electrical) with a system by variation of a physical parameter (pressure, force or other).

Thus, the control of the gas valve (that is, the first regulator) preferably includes an electronic controller, if necessary in combination with a pneumatic control system (for example, the electronic regulator could act on one or more setting parameters designed to determine the operational characteristic of the pneumatic or mechanical regulator in general). For this reason, the control unit is configured to control (directly or indirectly) the gas regulating valve.

According to a preferred embodiment, the control unit is configured for controlling the gas regulating valve in real time.

This control by the control unit makes it possible to release the gas flow rate from the pressure upstream of the mixing zone. The regulation of the gas flow rate is in fact carried out by processing control signals coming from the monitoring device.

The device comprises a fan. The fan rotates at a variable speed of rotation. The fan is positioned in the intake duct to generate therein a workflow. According to an embodiment, the flow has direction of inflow, oriented from the inlet to the delivery outlet. According to an embodiment, the fan is connected to the control unit. According to an embodiment, the control unit is configured for sending control signals to the fan, for varying the rotation speed of the fan.

According to an embodiment, the fan is positioned in the intake duct in a position upstream of the mixing zone in the direction of inflow. According to another embodiment, the fan is positioned in the intake duct in a position downstream of the mixing zone in the direction of inflow.

The device comprises a second regulator. The second regulator is coupled to the intake duct. According to an embodiment, the second regulator is located upstream of the fan in the direction of inflow. According to another embodiment, the second regulator is located downstream of the fan in the direction of inflow.

According to an embodiment, the second regulator is located upstream of the mixing zone in the direction of inflow. According to another embodiment, the second regulator is located downstream of the mixing zone in the direction of inflow.

The second regulator is configured for varying a cross section of the intake duct. The second regulator is configured for varying the cross section of the intake duct in a continuous fashion. According to an embodiment, the cross section is located upstream of the mixing zone in the inflow direction.

According to an embodiment, the cross section is located downstream of the mixing zone in the inflow direction.

According to an embodiment, the second regulator is configured to vary in a continuous fashion the cross section of the intake duct, as a function of the speed of rotation of the fan.

This makes it possible to keep the head losses through the second regulator ideally constant. Consequently, an increase in the request for thermal power does not correspond to an excessive increase in electricity consumption for rotation of the fan. Moreover, the reduction in noise of the device (and of the burner) at high flow rates is particularly appreciable.

According to an embodiment, the second regulator is connected to the control unit, in order to be controlled electronically using the control signals. According to an embodiment, the second regulator is a mechanical control regulator. According to an embodiment, the second regulator is a fluid-dynamic control regulator. In other words, in this embodiment, the second regulator is controlled through variation of mechanical or fluid-dynamic parameters and not by the sending of electrical signals. According to an embodiment, the second regulator is a "direct" control regulator. The term "direct" means that the regulator modifies a relative operating condition by measuring directly the variation in a predetermined parameter.

This feature has the advantage of increasing the constructional simplicity as well as the reliability of the second regulator, given the smaller number of parts involved in the regulation.

According to an embodiment, the second regulator comprises a shutter. According to an embodiment, the second regulator comprises a housing.

The shutter is subjected to a first pressure, applied in a position upstream of the shutter. The shutter is subjected to a second pressure, applied in a position downstream of the shutter. The shutter is thus subjected to a differential pressure, equal to the difference between the first pressure and the second pressure.

According to an embodiment, the shutter is movable with respect to the housing, to vary in a continuous fashion the cross section of the intake duct as a function of the speed of rotation of the fan. According to an embodiment, the shutter is disengaged from the housing. The term "disengaged" means that the shutter is not connected rigidly to the housing.

According to an embodiment, the shutter is constrained to the housing to reduce the degrees of freedom of the shutter. This embodiment includes, for example but without restricting the scope of the invention, shutters hinged or floating with guide rods.

According to an embodiment, the shutter is mobile between a first limit position, corresponding to a first limit cross section and a second limit position, corresponding to a second limit cross section. According to an embodiment, the first limit cross section is different from zero. In other words, in the first limit position, the shutter does not totally occlude the passage of the oxidizer. The first limit cross section is less than the second limit cross section.

This feature is very advantageous since it allows design, as a function of the first limit cross section (and obviously the weight of the shutter or movable element), of the pressure value to be maintained at the minimum flow rate and at the lower flow rates. The subsequent variation of the cross section caused by the movement of the shutter guarantees almost total freedom in the design of the first limit cross section, providing the possibility of reaching very high mixing pressures also for very low flow rates.

According to an embodiment, the shutter is in contact with the housing only in the first limit position.

This embodiment is very advantageous because it considerably reduces the probability of blocking of the shutter which, on the contrary, is significant if the shutter is hinged or connected with a slide.

According to an embodiment, the shutter is configured to move relative to the housing under the effect of a variation of pressure in the intake duct. The pressure variation may be generated by the fan. The pressure variation is a variation of the second pressure. According to an embodiment, the pressure variation is a variation of mixing pressure.

According to an embodiment, the second pressure and the mixing pressure coincide.

According to an embodiment, the pressure variation may be generated by an external hydraulic circuit, configured to move the shutter, as a function of the speed of rotation of the fan.

According to an embodiment, the shutter is subjected to a hold pressure. The term "hold pressure" means a force configured to keep the shutter in the first limit position.

According to an embodiment, the shutter is configured to start to move from the first limit position under the effect of a cut-out pressure. The term "cut-out pressure" means the differential pressure on the shutter at a cut-out speed of the fan.

The cut-out pressure is greater than the hold pressure. The cut-out pressure of is directed in the opposite direction to the hold pressure.

According to an embodiment, the hold pressure is the weight of the shutter. According to an embodiment, wherein the device comprises a hold spring, the hold pressure is the elastic force of the hold spring. According to an embodiment, the hold force is a friction force between the walls of the housing and the shutter.

According to an embodiment, the hold pressure and the cut-out speed depend on the weight of the shutter. According to an embodiment, the cut-out speed depends on the first limit cross section. The cut-out speed is a function of the ratio between the weight of the shutter and the first limit cross section. In fact, with an increase in weight the cut-out speed increases, whilst with a decrease in the first limit cross section the cut-out speed decreases.

This feature is fundamental for increasing the flexibility of the system. In fact, by acting on the hold pressure, it is possible to vary the cut-out pressure and consequently the cut-out speed, the speed at which the head losses stabilise due to the variation of the cross section.

According to an embodiment, the second regulator comprises a ball. According to an embodiment, the second regulator comprises a conical duct with increasing cross section in the inflow direction. According to an embodiment, the ball is movable in the conical duct along a sliding direction, perpendicular to the cross section and parallel to the weight force direction.

According to an embodiment, the sliding direction may be parallel to the weight force, perpendicular to the weight force or inclined relative to the weight force by an angle of between zero and ninety degrees.

According to an embodiment, the shutter is the ball. The shutter can also be a floating plate, a hinged plate or a gate valve.

According to an embodiment, the housing is a duct with a variable cross section of the second regulator. According to an embodiment, the housing is a duct with a constant cross section.

The housing may be the conical duct. The housing may be a conical duct with increasing cross section in the inflow direction.

According to an embodiment, the shutter is movable with respect to the housing along a sliding direction, perpendicular to the cross section and parallel to the weight force direction. According to an embodiment, the sliding direction may be perpendicular to the direction of the weight force. According to an embodiment, the sliding direction may be parallel to the cross section.

According to an embodiment, the second regulator is an "Asameter"®. The second regulator is configured for operating according to the physical principle of the "Asameter"®.

In particular, the Asameter ® is a device generally used for the dynamic measurement of the flow rate of a fluid. The Asameter ® comprises a body floating inside a conical guide (or with a variable cross section). Between the guide and the floating body the Asameter ® comprises a passage which allows the fluid to flow through the guide, passing beyond the floating body. The guide extends along the vertical direction, since the Asameter ® is calibrated as a function of the weight of the floating body.

When the Asameter ® is used as a flow measuring device, the height of the floating body in the guide indicates the fluid flow rate. In fact, the fluid has a head loss across the floating body which is proportional to the speed of the fluid, the weight of the floating body and the passage cross section. For this reason, if the weight of the floating body and the passage cross section along the guide is known it is possible to determine the speed (and hence the flow rate) of the fluid for each position of the floating body.

According to the invention, the Asameter ® is not used as a flow rate measuring device. In fact, the second regulator uses the operating principle of the Asameter ® (for example, as described above) for keeping the head losses through the regulator constant for fluid flow rates greater than a minimum flow rate (below which the flow rate is not sufficient to lift the floating body of the base of the Asameter ® on which the floating body lies). In any case, it is also envisaged that the second regulator is used to measure the flow rate, in addition to the above-mentioned function of keeping the head losses through the regulator constant.

According to an aspect of the invention, the invention also intends to protect a premix burner.

According to an embodiment, the premix burner comprises a control device comprising one or more of the features described above. The burner comprises a combustion head.

The combustion the head includes an ignition device. The ignition device is configured to allow the triggering of the combustion in the combustion head.

According to an embodiment, the combustion head is connected to the control device through the delivery outlet. The combustion head is configured to house the monitoring device.

According to an aspect of this invention, the protection also extends to a method for controlling the fuel-oxidizer mixture for premix gas burners.

The method comprises a step of admitting oxidizer into an intake duct through an inlet. The method comprises a step of delivering fuel-oxidizer mixture through an outlet.

The method comprises a step of mixing oxidizer and fuel in a mixing zone. For clarity in the subsequent description, the term "mixing pressure" is used to mean the pressure which governs inside the mixing zone. For clarity in the subsequent description, the term "operating pressure" is used to mean the head provided by the fan, that is to say, the difference between the pressure at the fan inlet and the pressure at the fan outlet.

The method comprises a step for feeding fuel to the mixing zone. The feeding step is carried out by means of an injection duct connected to the intake duct in the mixing zone.

The method comprises a step for monitoring a combustion, by using a monitoring device. According to an embodiment, the method comprises a step of generating control signals, by means of the monitoring device. According to an embodiment, the monitoring device sends the control signals.

The method comprises a step of receiving and processing the control signals in the control unit.

The method comprises a step of generating command signals from a control unit, as a function of the control signals.

According to an aspect of the invention, the method comprises a first regulation step. The first regulation step is a regulation of a fuel flow rate. The first regulation step is performed as a function of the command signals, by means of a first regulator located on the injection duct. The first regulator receives the command signals from the control unit and regulates the flow rate of fuel. According to an embodiment, the first regulator receives the command signals and moves a shutter by electrical pulses. According to an embodiment, the control unit sends in real time the command signals continuously varying the fuel flow rate as a function of the combustion conditions.

This feedback check of the combustion makes it possible to have a variable supply whilst always maintaining the fuel-oxidizer ratio at its optimum value.

The method comprises a step of rotation of a fan at a variable speed of rotation. The rotation step comprises a step of generating a flow in the intake duct in a inflow direction, oriented from the inlet to the outlet. In the rotation step of the fan the oxidizer, or the oxidizer-fuel mixture, receive a working pressure, such as to allow to the mixture to reach a combustion head.

According to an aspect of the invention, the method comprises a second regulation step. The second regulation step is a step of regulating a flow rate of oxidizer by means of a second regulator coupled to the intake duct. In this second regulation step, a cross section of the intake duct varies. According to an embodiment of this second regulation step, the cross section of the intake duct varies in a continuous fashion. According to an embodiment, in the second regulation step, the cross section of the intake duct is located upstream of the mixing zone in the inflow direction and varies in a continuous fashion, as a function of the rotation speed of the fan.

According to an embodiment, in the second regulation step a shutter of the second regulator moves.

The shutter is subjected to a first pressure, applied in a position upstream of the shutter. The shutter is subjected to a second pressure, applied in a position downstream of the shutter. The shutter is thus subjected to a differential pressure, equal to the difference between the first pressure and the second pressure.

According to an embodiment, the shutter moves due to the effect of a pressure variation. According to an embodiment, the shutter moves controlled by the control unit using the control signals.

According to an embodiment, the shutter moves along a direction parallel to the direction of the weight force. According to other embodiments this invention also intends to protect, the shutter may, the other hand, move in a direction perpendicular to the weight force. Moreover, the shutter may move in a direction perpendicular to the cross section or in a direction parallel to the cross section.

According to an embodiment, the shutter moves by effect of a variation of pressure generated in a pneumatic control circuit.

According to an embodiment, the shutter moves by effect of a variation of the second pressure. According to an embodiment, the second pressure and the mixing pressure coincide. The pressure variation may be generated by the fan. The pressure variation is generated by a variation in speed of rotation of the fan. In particular, the fan, by modifying its speed of rotation, modifies the flow rate of mixture which passes through the second regulator and, therefore, the head losses. Varying the extent of the head losses varies the second pressure of the shutter.

According to an embodiment, in the second regulation step a shutter of the second regulator moves from a first limit position, which corresponds to a first limit cross section, different from zero, to a second limit position, which corresponds to a second limit cross section. The movement of the shutter from the first limit position to the second limit position causes an increase in the cross section. In other words, the first limit cross section is less than the second limit cross section.

When the flow rate is increased by the control unit due to an increase in the thermal power request, the fan varies its speed of rotation.

The variation of rotation speed causes an increase in the flow rate and consequently an increase in the head losses through the second regulator. The increase in the head losses causes the variation of the second pressure (according to an embodiment coinciding with the mixing pressure). The pressure variation then acts on the shutter which moves between a plurality of positions in the range between the first limit position and the second limit position. Vice versa, when the thermal power required decreases, the fan reduces the speed of rotation and the oxidizer (or mixture) flow rate. Reducing the flow of oxidizer reduces the head losses through the second regulator and there is an increase in the second pressure. This increase of pressure causes the movement of the shutter.

According to an embodiment, the shutter is held in the first limit position by a hold pressure.

According to an embodiment, the second regulation step comprises a cut-out step. According to an embodiment, in the cut-out step, the pressure variation which causes the movement of the shutter exceeds the hold pressure and the shutter starts to move.

According to an embodiment, in the cut-out step, the fan generates on the shutter a cut-out pressure, corresponding to a cut-out speed. In particular, the fan rotates at the cut-out speed and generates the cut-out pressure, which means the pressure differential on the shutter at the cut-out speed of the fan. According to an embodiment, the cut-out pressure is greater than the hold pressure and directed in the opposite direction to the hold pressure. According to an embodiment, the hold pressure is exerted by the relative weight of the shutter. According to other embodiments, the hold pressure may be exerted by a spring or may be a friction force between the shutter and its housing.

The second regulation step is described in more detail below, making reference to the case in which the variation of the second pressure is generated by the fan without this resulting in any limitation to this embodiment. What is described below can be extended to other embodiments, known to experts in the field, used for varying the pressure in an environment. The same generalisations apply to the hold pressure which in the following description is generated by the weight of the shutter but may be generated by all the variants previously described.

According to an aspect of the invention, the second regulation step comprises one or more of the following steps:

Control with constant cross section:

Cut-out

Control with variable cross section.

In the control with a constant cross section, the hold pressure on the shutter is greater than the differential pressure on the shutter. In other words, the head losses through the shutter are smaller than the weight of the shutter (or of the elastic force of the spring, or the friction between shutter and housing). In this control step the head losses increase according to the square of the flow rate of the oxidizer. This regulation makes it possible to obtain working high pressures also for low flow rates.

In the cut-out step the differential pressure (cut-out pressure) firstly equals then exceeds the hold pressure, causing a first movement of the shutter from the first limit position. The first movement of the shutter causes an increase in the cross section and a consequent reduction in the head losses (therefore an increase in the mixing pressure). This allows a stabilisation of the shutter in a stabilisation position at a predetermined oxidizer flow value. The stabilising position, with the same flow rate, varies as a function of the weight of the shutter.

When the shutter has performed the first movement it enters in the control step with variable cross section. In this step, the position of the shutter varies as a function of the flow rate of oxidizer circulated by the fan. This means, in the non-limiting example embodiment being described, that with the increase in the rotation speed of the fan the shutter increases the cross section and, vice versa, with the reduction of the rotation speed of the fan the shutter reduces the cross section. This occurs, in the embodiment in which the shutter is subject only to the relative weight, because the stabilising condition is represented by the equality between the weight of the shutter and the differential pressure on the shutter. When the fan reduces the speed, the pressure difference decreases (downstream pressure increase) and, consequently, the shutter moves in the direction which causes reduction in the cross section. This movement will return the value of the head losses to the equality with the weight of the shutter. Vice versa, when the fan increases the speed, the pressure difference increases (second pressure decreases) and, consequently, the shutter moves in the direction which causes an increase in the cross section. This movement will return the value of the head losses to the equality with the weight of the shutter. In short, in the control with a variable cross section, the head losses remain ideally constant. This makes it possible to vary the working range always keeping the optimum working pressure conditions, that is to say, the same head losses through the second regulator.

The reduction of the maximum operating pressure and the increase of the minimum operating pressure can also be deduced from Table 1, below, and FIG. 7, which show the trend of the operating pressure as a function of the thermal power (flow rate). The first line 700 in FIG. 7 refers to the solution of the present invention, whilst the second line 710 in FIG. 7 refers to an existing solution.

TABLE 1

Operating pressure and thermal power comparison

| Power (kW) | dP of Present Technology (Pa) | dP of Existing Solution (Pa) |
|---|---|---|
| 1.70 | 135.00 | 1.49 |
| 1.82 | 158.00 | 1.71 |
| 4.70 | 188.00 | 11.40 |
| 9.02 | 220.00 | 41.98 |
| 12.30 | 242.00 | 78.06 |
| 16.35 | 268.00 | 137.94 |
| 19.08 | 286.00 | 187.84 |
| 22.80 | 308.00 | 268.23 |
| 25.60 | 330.00 | 338.16 |
| 28.50 | 355.00 | 419.11 |
| 31.40 | 385.00 | 508.75 |
| 34.10 | 415.00 | 600.00 |

BRIEF DESCRIPTION OF SEVERAL VIEWS OF THE DRAWING

This and other features will become more apparent from the following description of a preferred embodiment of the invention, illustrated by way of non-limiting example in the accompanying tables of drawings, in which.

DETAILED DESCRIPTION OF THE INVENTION

Figure 1A:
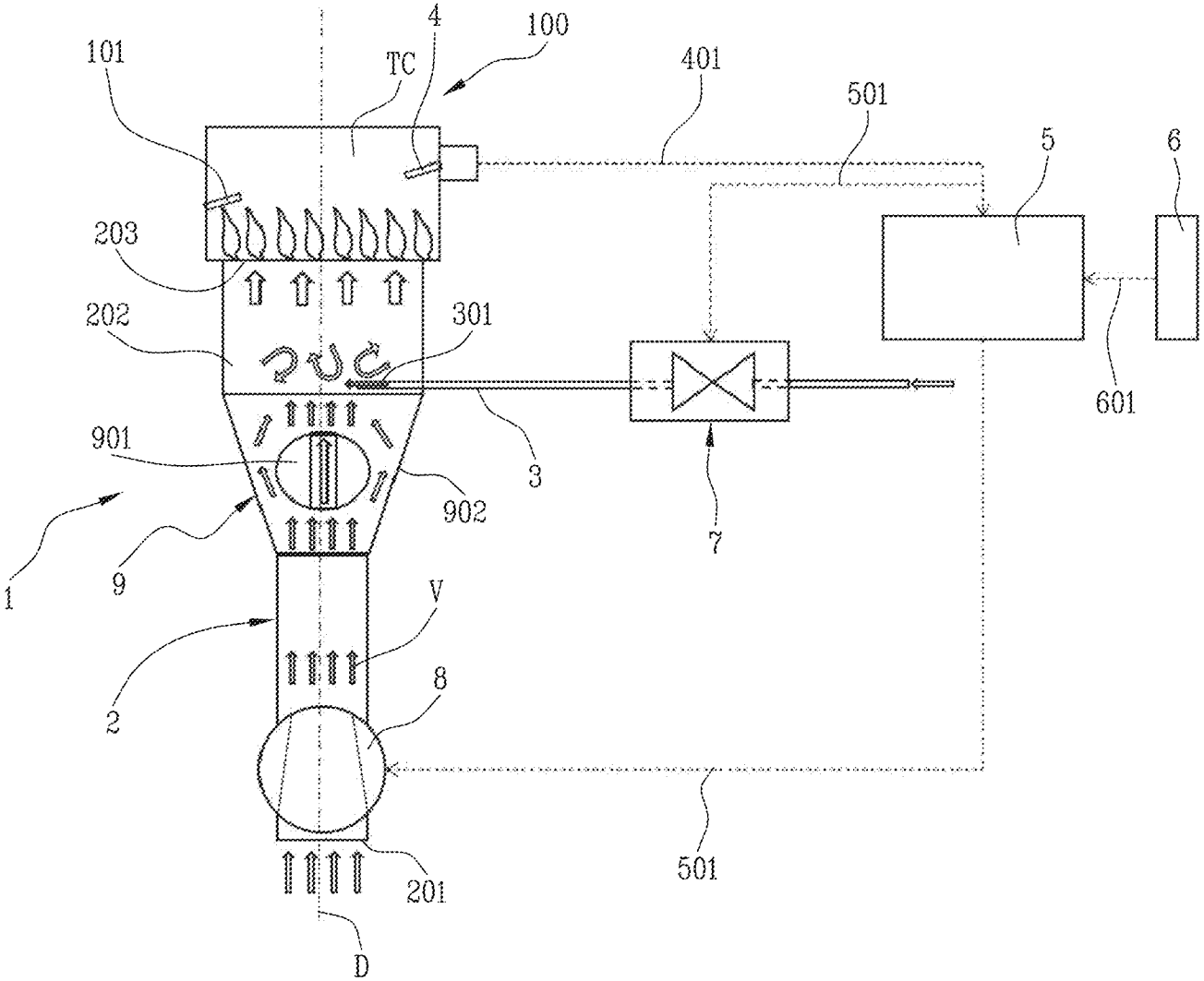
FIGS. 1A, 1B, 1C and 1D schematically illustrate four embodiments of a device for controlling the mixture, respectively.
Figure 1B:
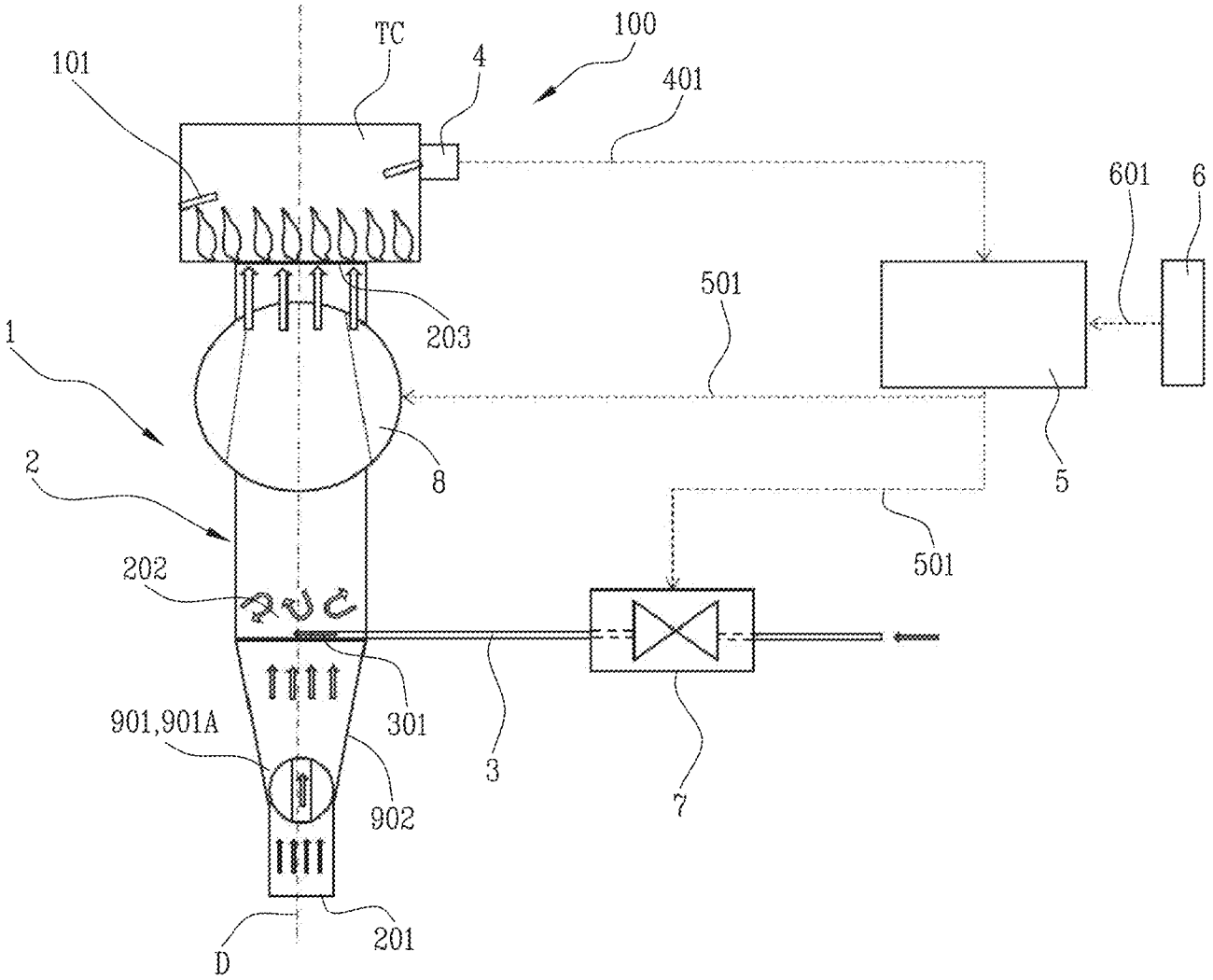
Figure 1C:
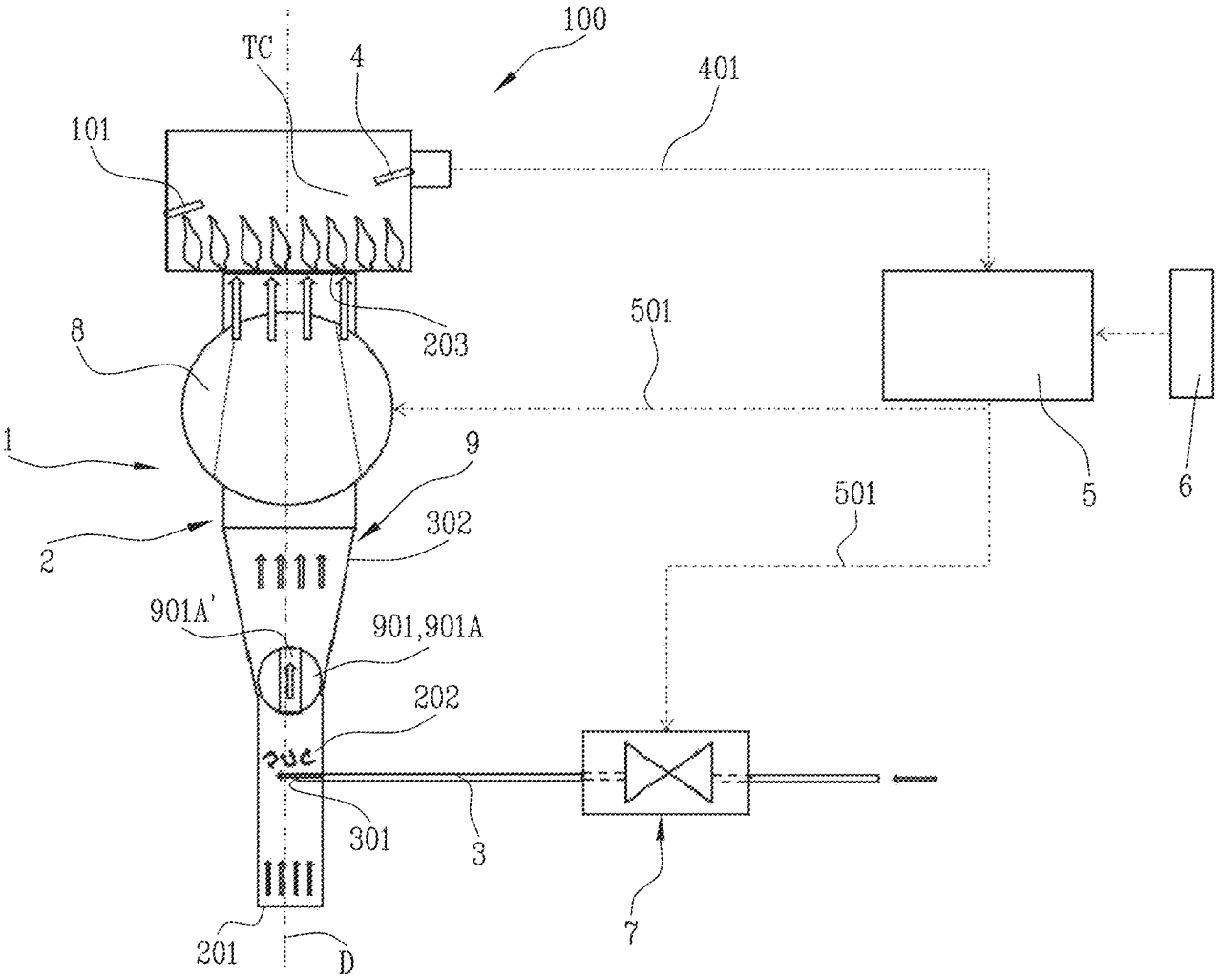
Figure 1D:
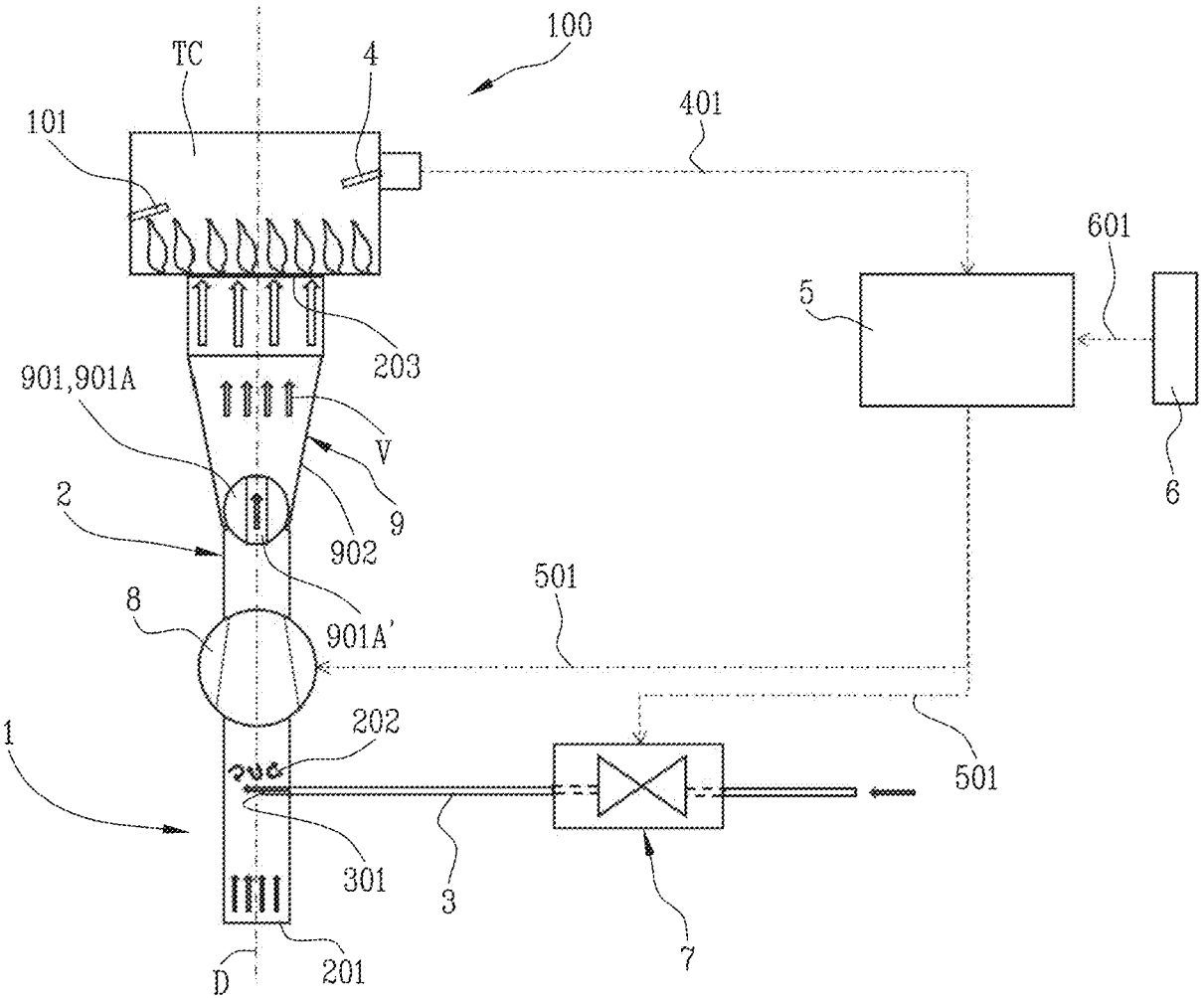

In particular, the accompanying drawings denote with the reference numeral 1 in FIGS. 1A, 1B, 1C and 1D, a device for controlling the fuel-oxidizer mixture in premix gas burners. The term "air" will be used below when referring to the oxidizer without wishing to limit the scope of protection to this type of oxidizer.

Moreover, the term "fluid" will be used to refer without distinction to air or to the air-gas mixture.

The device 1 comprises an intake duct 2. The intake duct 2 comprises an inlet 201. The intake duct 2 comprises an outlet 203. The intake duct 2 comprises a mixing zone 202.

The inlet 201 is in contact with the outside environment to allow the entry of air into the intake duct 2 at ambient pressure Pa.

The delivery outlet 203 opens onto a combustion head TC in which the air/gas mixture is burnt.

The mixing zone 202 is between the inlet 201 and the outlet 203 and is configured to allow an adequate mixing between the gas and air.

The intake duct 2 is passed through by a work flow in a direction of flow D and in a direction of inflow V, oriented from the inlet 201 to the outlet 203.

The intake duct 2 may have a variable cross section along a direction of flow D.

The device 1 comprises an injection duct 3. The injection duct 3 is connected with the intake duct 2. In particular, the injection duct 3 is connected with the intake duct 2 at the mixing zone 202. The injection duct 3 comprises an injection nozzle 301, located at a first end of the intake duct 3. The injection duct is in communication with the mixing zone 202 through the injection nozzle 301.

A second end of the injection duct 3, which is opposite the injection nozzle 301, is, on the other hand, connected to gas supplier, for example, the gas mains.

According to an embodiment, the device 1 comprises a monitoring display 4. The monitoring device is configured to detect control signals 401 inside the combustion head TC. The control signals 401 represent the state of combustion inside the combustion head TC. The monitoring device 4 may be a flame detector or any other system, known to an expert in the trade, which is able to detect significant information representative of the combustion.

According to an embodiment, the device 1 comprises a control unit 5. According to an embodiment, the device 1 comprises a user interface 6. The control unit 5 is connected with the monitoring device 4 and with the user interface 6. The control unit 5 is programmed for receiving the control signals 401 from the monitoring device 4. The control unit 5 is programmed to receive input signals 601 from the user interface 6.

The control unit 5 is programmed for processing the control signals 401. According to an embodiment, the control unit 5 is programmed to process the input signals 601.

The control unit 5 is programmed to generate drive signals 501, as a function of the control signals 401.

According to an embodiment, the control unit 5 is programmed to generate drive signals 501, as a function of the input signals 601.

According to an embodiment, the device 1 comprises a first regulator 7. The first regulator 7 is positioned on the injection duct 3 in such a way as to intercept the flow of gas in the injection duct 3. The first regulator 7 is connected to the control unit 5.

According to an embodiment, the control unit 5 is programmed to send the drive signals 501 to the first regulator 7.

According to an embodiment, the first regulator 7 is controlled by the control unit 5 by means of the control signals.

The first regulator 7 comprises a movable element. The movable element of the first regulator 7 is configured to vary a relative position as a function of the drive signals 501. In particular, the position of the movable element of the first regulator 7 influences the flow of gas which is adopted in the mixing zone 202. According to an embodiment, the first regulator 7 is a gas valve equipped with motor-driven actuators, controlled by the control unit 5 by means of the drive signals 501. According to another embodiment, the first regulator 7 is a gas valve equipped with solenoid-type actuators, controlled by the control unit 5 by means of the drive signals 501. According to another embodiment, the first regulator 7 is a gas valve equipped with actuators the action of which is subject to pneumatic (delta P) and electric (motor or solenoid) quantities, controlled by the control unit 5 by means of the drive signals 501.

According to an aspect of the invention, the gas flow rate is independent of the air pressure in a position upstream of the mixing zone 202, but depends only on the control signals 401, representing the state of combustion.

According to an embodiment, the device 1 comprises a fan 8.

The fan 8 is configured to rotate at a variable rotation speed. The speed of rotation of the fan is included in a range delimited by a first limit rotation speed and a second limit rotation speed, greater than the first limit speed of rotation.

Figure 6A:
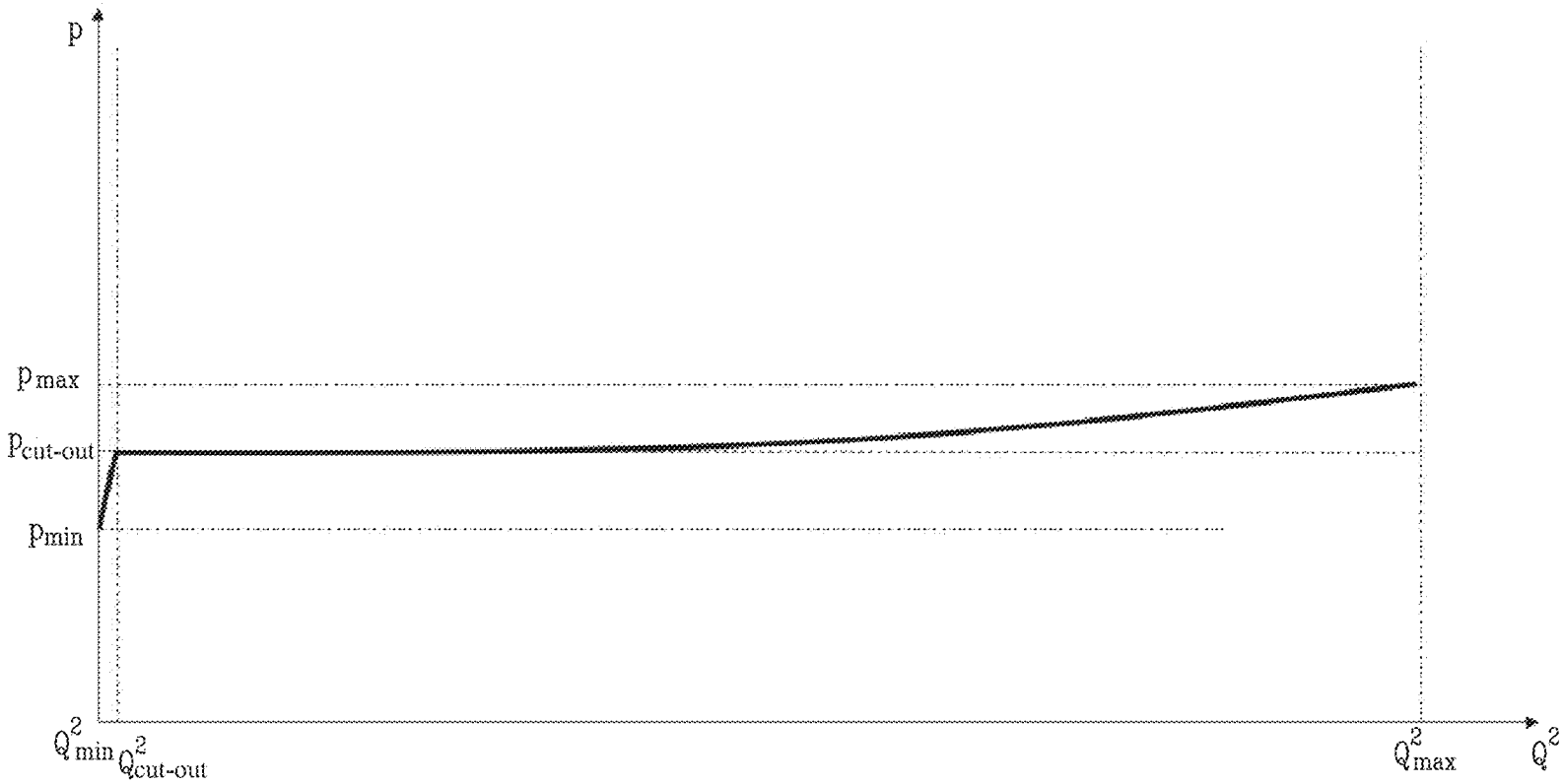
FIGS. 6A and 6B illustrate the diagram of the operating pressure as a function of the flow rate of mixture in the ideal case and in the real case, respectively.
Figure 6B:
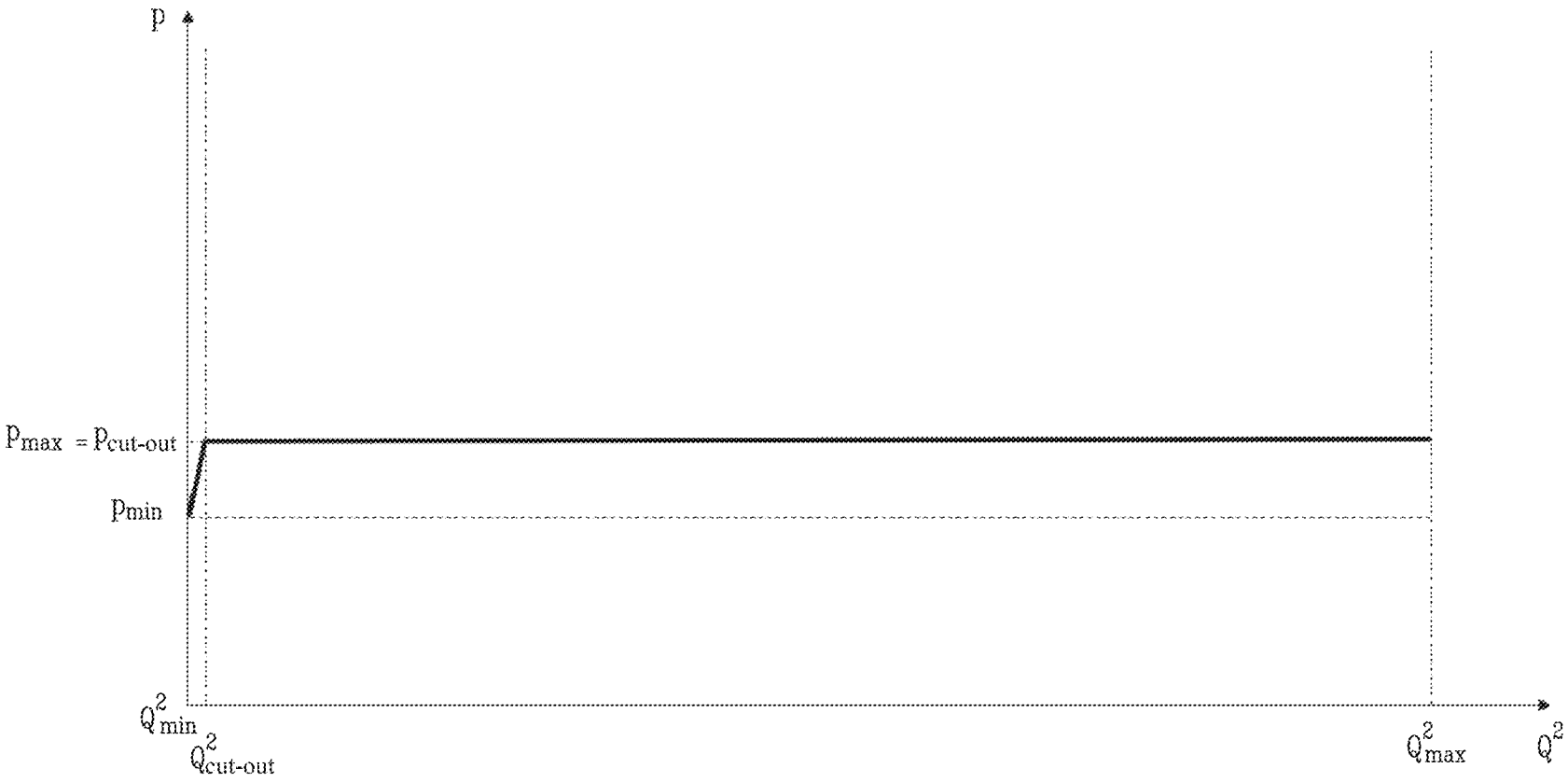
Figure 7:
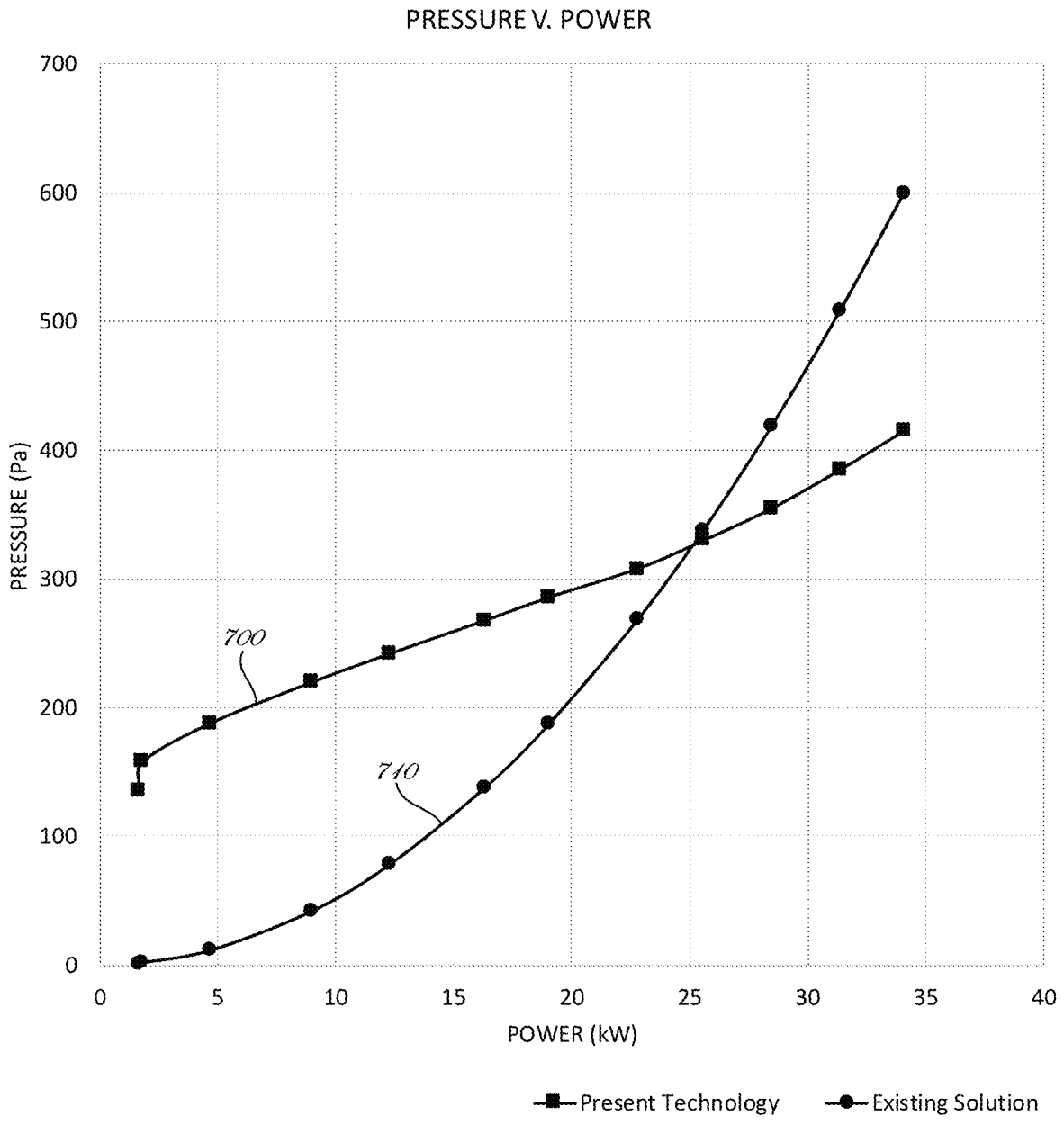
FIG. 7 is a plot showing a graphical comparison of Pressure vs. Power for an embodiment of the present technology relative to an existing technology.

The device 1 is configured for operating within a range of mixture flow rates between a first limit flow rate $Q_{min}$ and a second limit flow rate $Q_{max}$, greater than the first limit flow rate $Q_{min}$, as represented in FIGS. 6A and 6B, for example.

It should be noted that the fan 8 is configured to rotate at the first limit rotation speed for the first limit flow rate $Q_{min}$ and to rotate at the second limit speed for the second limit flow rate $Q_{max}$.

The fan 8 is positioned in the intake duct 2. The axis of rotation of the fan 8 is parallel to the direction of flow D. The fan 8 is configured to generate the operating flow inside the intake duct.

According to an embodiment, the fan 8 is connected to the control unit 5. According to an embodiment, the fan 8 is controlled by the control unit 5 by means of the drive signals 501.

The fan 8 is configured to provide to the air (or to the mixture) an operating pressure which allows the fluid to reach the combustion head TC.

Figure 4A:
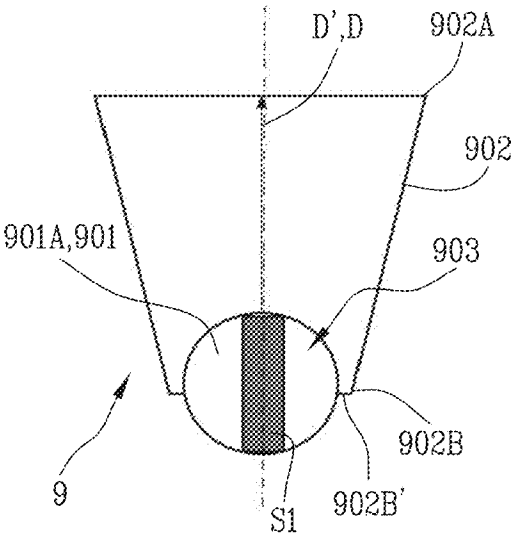
FIG. 4A, 4B, 4C schematically illustrate a first limit position, an intermediate position and a second limit position of a shutter of the second regulator relative to a housing of the second regulator, respectively.
Figure 4B:
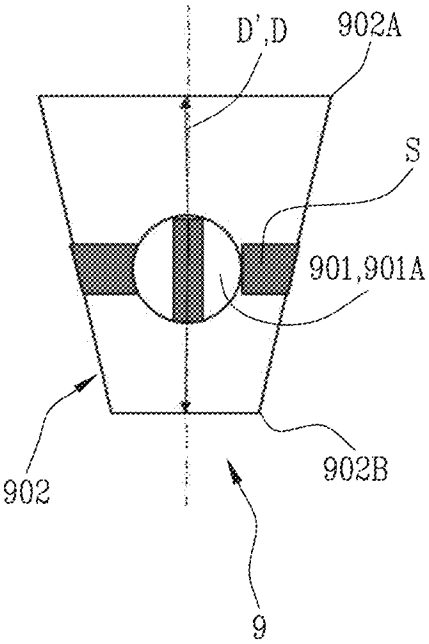
Figure 4C:
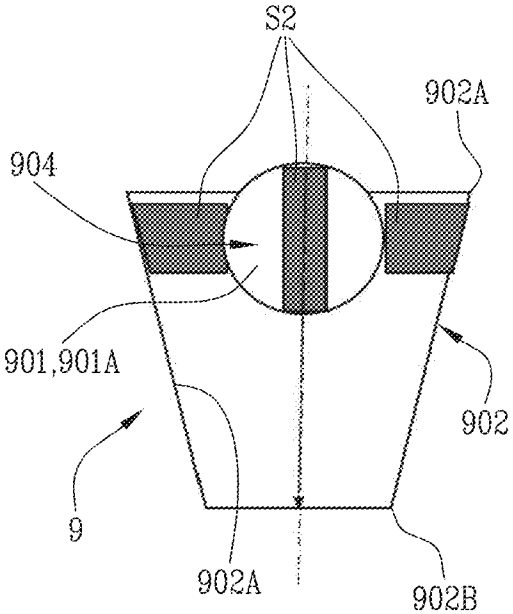

According to an embodiment, the device 1 comprises a second regulator 9. The second regulator 9 is configured for varying a cross section S (e.g., FIG. 4B) of the intake duct 2.

According to an embodiment, the second regulator 9 is positioned upstream of the fan 8 in the inflow direction V. According to another embodiment, the second regulator 9 may be located downstream of the fan 8 in the inflow direction V.

The difference between these two embodiments lies in the different trend of the pressures of the air and then of the mixture along the intake duct 2. In particular, if the fan 8 is located downstream of the second regulator 9 in the inflow direction V, the fan will have suction pressure less than the ambient pressure. If, on the other hand, the fan 8 is positioned upstream of the second regulator 9 in the inflow direction V, then the suction pressure of the fan suction 8 will be equal to the ambient pressure. The position of the fan 8 does not, however, change the aim of the invention. For sake of brevity, the description below will refer to the embodiment wherein the second regulator 9 is located downstream of the fan 8, without this wishing to limit the scope of the invention to this single solution.

According to an embodiment, the second regulator 9 is located upstream of the mixing zone 202 in the inflow direction V. The second regulator 9 is subjected to a first pressure, applied by the fluid in a first position 91 (FIG. 2A) of the intake duct 2 upstream of the second regulator 9. The second regulator 9 is subjected to a second pressure, applied by the fluid in a second position 92 of the intake duct 2 downstream of the second regulator 9. The second regulator 9 is subjected to a differential pressure, resulting from the difference between the first pressure and the second pressure.

According to a preferred embodiment, the second regulator 9 is a mechanical control regulator. This definition means a regulator which responds to stimuli of a mechanical or fluid-dynamic nature and not to electrical pulses. However, this does not mean excluding the solution in which the second regulator 9 can be controlled by the control unit 5, by further drive signals 501.

According to an embodiment, the second regulator 9 is a "direct" control regulator. This definition describes a solution in which the regulator is configured to detect itself a variation of a parameter which determines a corresponding variation in its operating condition. What is expressed in this paragraph will be described in more detail below, when the forces to which the second regulator 9 is subjected are described. In this case, too, the intention is not to exclude an "indirect" regulator from the scope of protection, that is to say, which needs a controller to vary the relative operating condition.

In fact, according to an embodiment, the control unit 5 can be connected to the second regulator 9.

According to an embodiment, the second regulator 9 comprises a shutter 901. The shutter 901, according to an embodiment, is a ball 901A. According to other embodiments, the shutter 901 may be a floating plate 901B or a gate valve 901C.

According to other embodiments, which can be equally implemented, the shutter 901 may be a vane hinged to the housing 902, configured to rotate about a hinge and to vary the cross section S of the intake duct 2. According to an embodiment, the shutter 901 may be a float with a guide rod.

According to an embodiment, the shutter 901 comprises a passage hole 901'.

According to an embodiment, the shutter 901 has a relative weight P.

Reference will be made hereafter to the shutter 901 in its preferred embodiments in which it is a ball 901A, without any limitations to the scope of protection.

According to an embodiment, the second regulator comprises a housing 902. The housing 902 is configured for containing the ball 901A. According to an embodiment, the housing 902 is a duct with a variable cross section along the direction of flow D. According to another embodiment, the housing 902 is a duct with a constant cross section along the direction of flow D. The housing 902 is fixed to the intake duct 2.

According to an embodiment, the ball 901A is movable inside the housing 902. The ball 901A is movable between a first limit position, 903 and a second limit position 904, for varying in a continuous fashion the cross section S. The first limit position of the ball 901A corresponds to a first limit cross section S1 (e.g., FIGS. 3A-3D and 4A). The second limit position of the ball 901A corresponds to a second limit cross section S2 (e.g., FIGS. 3A, 3C, 3D and 4C). According to an embodiment, the first limit cross section S1 is different from zero. In other words, the ball 901A is configured to allow the passage of fluid even when it is in the first limit position 903.

According to an embodiment, the second regulator comprises a transit channel, configured to allow a passage of mixture from the first position 91 (upstream of the shutter) to the second position 92.

According to an embodiment, the ball 901A comprises a passage hole 901A'.

According to an embodiment, the first limit cross section S1 is defined by the area, along a plane perpendicular to the sliding direction D', of the passage hole 901A'.

According to an embodiment, the passage hole 901A' is not on the ball but is located between the ball 901A and the housing 902.

According to an embodiment, the passage hole 901A' é is a bypass hole 901A" and the ball 901A rests on the housing 902 and is configured to prevent a passage of mixture through the housing 902, in this way forcing the mixture to flow towards the bypass branch.

In particular, according to an embodiment, the housing 902 comprises a first tubular element 902C on which rests the ball 901A. According to this embodiment, the device 1 comprises an additional passage hole 901A' to form a plurality of passage holes 901A'. The plurality of passage holes 901A' is located on the first tubular element 902B (e.g., FIG. 2B) and is configured to place in communication the first position 91, located upstream of the ball 901A in the sliding direction D', with the second position 92, located downstream of the ball 901A in the sliding direction D'.

According to an embodiment, the housing 902 comprises a fixing flange 906, configured to allow the assembly of the second regulator 9 in the device 1.

According to the embodiment in which the passage hole 901A' is a bypass hole 901A", the bypass hole is executed on the fixing flange 906. The bypass hole 901A" is in communication with the first position 91, located upstream of the ball 901A in the sliding direction D', and with the second position 92, located downstream of the ball 901A in the sliding direction D'.

Figure 2B:
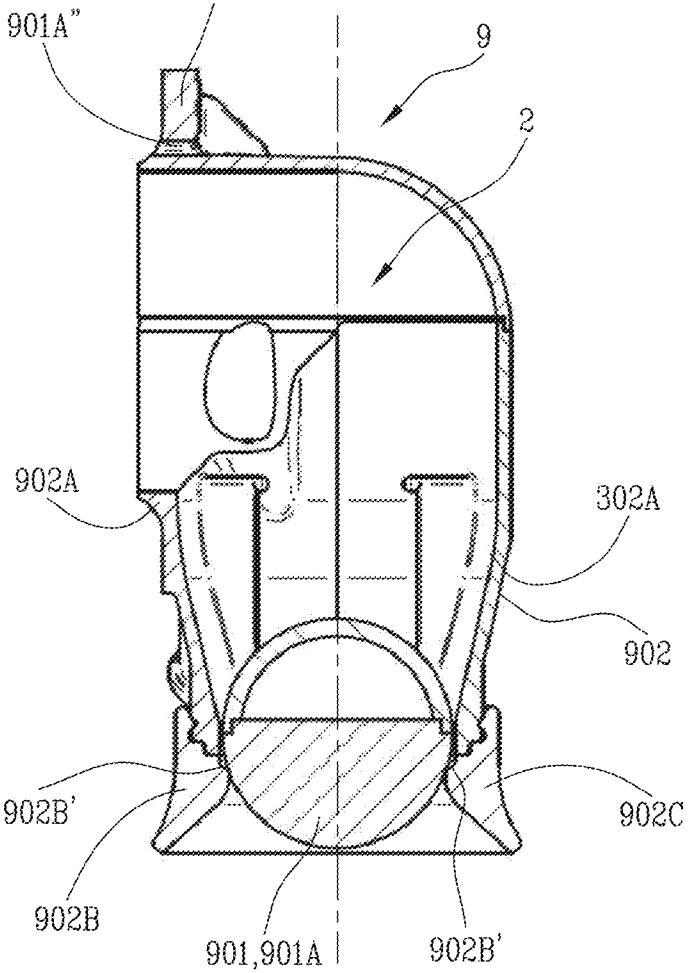
FIGS. 2A and 2B illustrate two embodiments of a second regulator of the device of FIG. 1A.
Figure 2A:
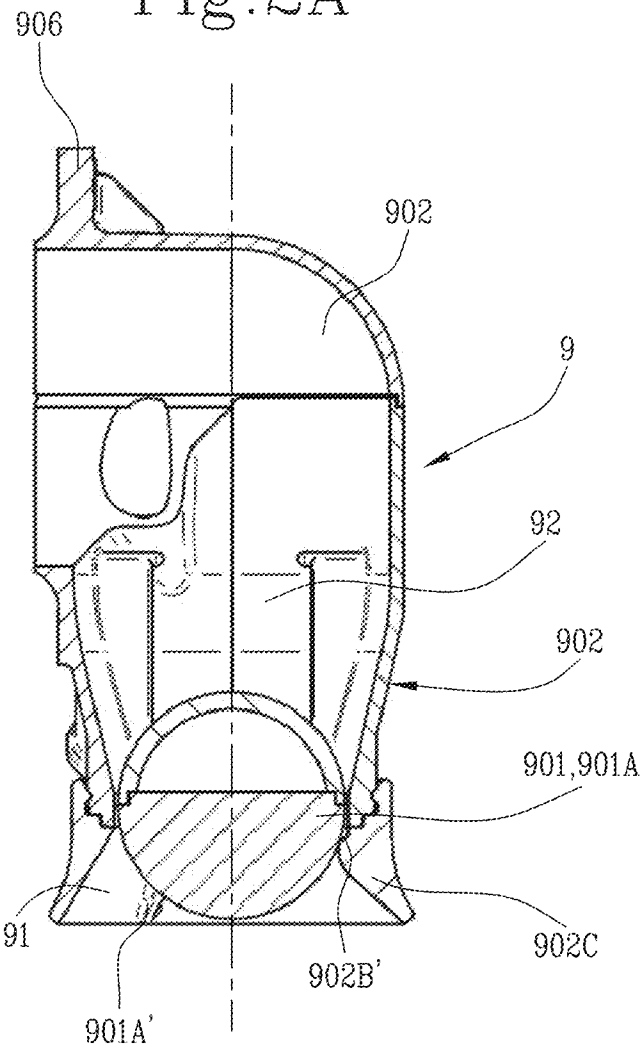
Figure 3A:
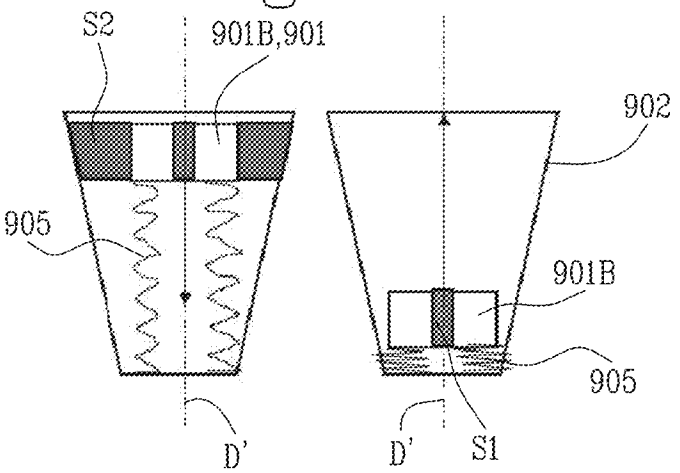
FIGS. 3A, 3B, 3C and 3D schematically illustrate four embodiments of the second regulator of FIG. 2A.
Figure 3B:
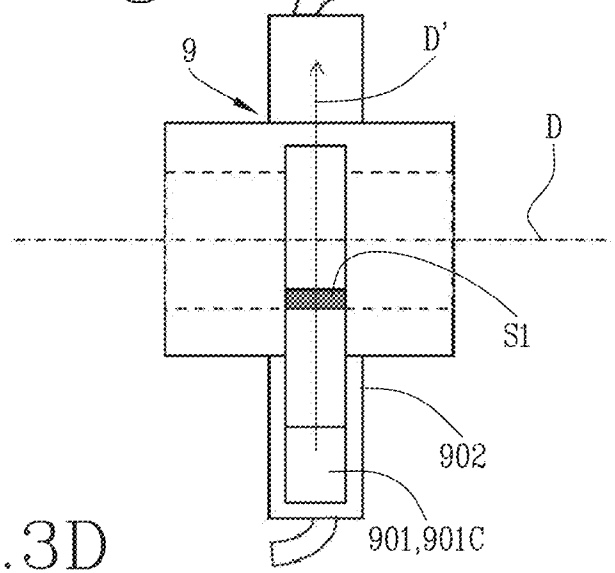
Figure 3C:
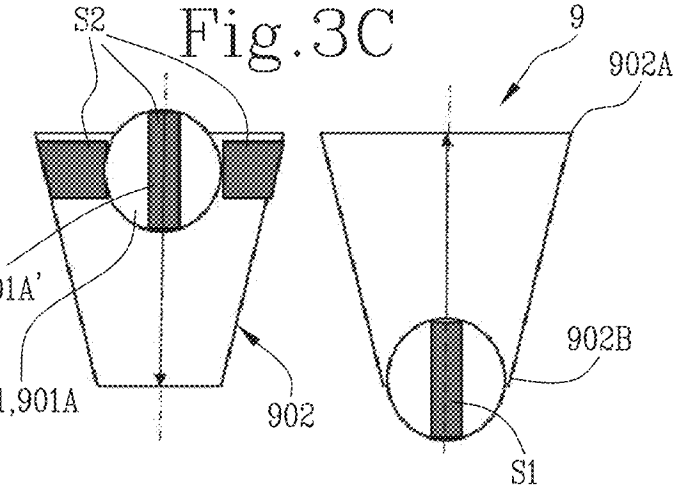
Figure 3D:
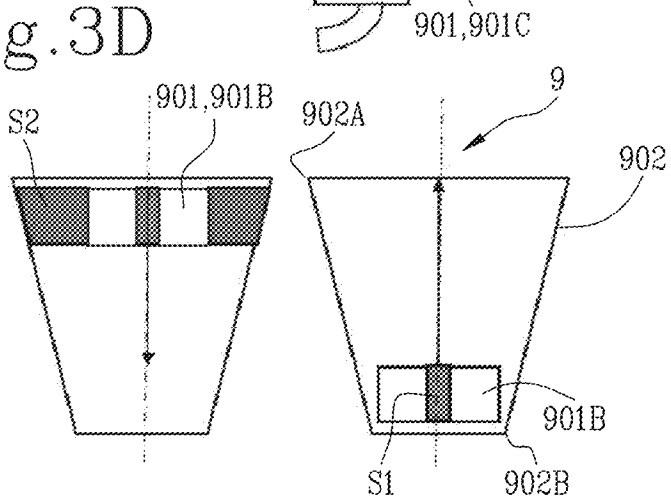

The first tubular element 902C comprises a shoulder 902B' (e.g., FIGS. 2A and 2B). The shoulder 902B' is located at the first end 902B of the housing 902 and is configured for supporting the ball 901A in its first limit position 903.

According to an embodiment, the ball 901A is movable along a sliding direction D' parallel to the direction of flow D. According to another embodiment, the sliding direction D' is, on the other hand, perpendicular to the direction of flow D.

According to an embodiment, the sliding direction D' is perpendicular to the direction of the weight force. According to another embodiment, the sliding direction D' is parallel to the direction of the weight force.

According to an embodiment, the ball 901A is in contact with the housing only in the first limit position 903 whilst in the other intermediate positions and in the second limit position 904 it is spaced from the walls 902A of the housing 902.

In the first limit position 903 the ball 901A rests on the housing 902 at a relative first end 902B. The housing 902 comprises a shoulder 902B', at its first end 902B, configured for supporting the ball 901A in its first limit position 903.

According to an embodiment, the ball 901A is configured to move under the effect of a pressure variation generated by the fan 8 in the intake duct 2 downstream of the second regulator 9, that is to say, downstream of the ball 901A. In other words the ball 901A is configured to move under the effect of a variation of the second pressure.

In particular, the differential pressure applied to the ball 901A is a function of the operating flow rate Q, which passes through the cross section S, and of the cross section S itself. It should be noted that whilst the first pressure depends on the elements located upstream of the second regulator 9 (such as, for example, the fan 8 or the outside environment at an ambient pressure), the second pressure is, on the other hand, a function of the operating flow rate Q, which passes through the cross section S, and the cross section S itself.

According to an embodiment, the ball is subjected to a hold pressure. The hold pressure is a pressure configured to hold the ball 901A resting on the shoulder 902B' of the housing 902. The drawings show two types of hold pressure.

According to an embodiment, the hold pressure is determined by the relative weight of the ball 901A. According to another embodiment, the hold pressure is determined by an elastic force generated by a return spring 905. According to other embodiments, suitable friction forces between the side walls 902A of the housing and the ball 901A might be worthwhile, which are able to hold, by static friction, the ball 901A in its first limit position 903.

The embodiments of the hold pressure described may obviously be coupled and redundant.

The description below will therefore consider the hold pressure to be dependent on the weight of the ball 901A without wishing to limit in any way the scope of protection.

According to an embodiment, the fan 8 is configured to rotate at a cut-out speed. The cut-out speed is between the first limit rotation speed and the second limit rotation speed.

The cut-out speed corresponds to a corresponding cut-out flow rate. According to an embodiment, the fan 8 is configured for generating a cut-out pressure $p_{cut\text{-}out}$. The cut-out pressure $p_{cut\text{-}out}$ is the second pressure exerted on the ball 901A with the rotation speed of the fan 8 equal to the cut-out speed.

According to an embodiment, the cut-out pressure $p_{cut\text{-}out}$ is greater than the hold pressure.

According to an embodiment, the cut-out pressure $p_{cut\text{-}out}$ is a function of the weight of the ball 901A. According to other embodiments, the cut-out pressure $p_{cut\text{-}out}$ is a function of the elastic force of the return spring 905 or, if necessary, a friction force.

According to an embodiment, the ball 901A is configured to start to move in the sliding direction D' with the fan 8 in rotation at the cut-out speed.

According to an embodiment, the second regulator is configured to perform a regulation with a constant cross section. According to an embodiment, the second regulator is configured to perform regulation with variable cross section.

The second regulator comprises two operating configurations: a first operating configuration, with a cross section S constant over time, corresponding to a first range of rotation speeds of the fan 8 and a second operating configuration, with a cross section S variable over time, corresponding to a second range of rotation speeds of the fan 8. The first range of rotation speed of the fan 8 is between the first limit rotation speed and the cut-out speed. The second range of the rotation speed of the fan 8 is between the cut-out speed and the second limit rotation speed.

According to an embodiment, in the first operating configuration, the ball 901A is configured to remain resting on the shoulder 902B' of the housing 902.

According to an embodiment, in the first operating configuration, the hold pressure is greater than the differential pressure.

According to an embodiment, in the second operating configuration, the ball 901A is configured to rise when the operating flow rate Q increases.

According to an embodiment, in the second operating configuration, the ball 901A is configured to lower when the operating flow rate Q decreases.

According to an embodiment, in the first operating configuration, the hold pressure is less than the differential pressure.

In the first operating configuration, the second regulator 9 is configured to increase the head losses through the second regulator 9 (that is to say, increase the differential pressure applied to the ball 901A). In the second operating configuration, the second regulator 9 is configured to ideally maintain constant the head losses through the second regulator 9 (that is to say, to keep constant the differential pressure applied to the ball 901A).

According to an embodiment, the second regulator 9 is configured for regulating the flow rate of fluid (air or mixture) using the physical principle of the "Asameter ®". According to an embodiment, the second regulator 9 is an "Asameter ®".

According to an aspect of this invention, the invention intends to protect a premix gas burner 100 comprising the device 1 according to any one of the features described above. The burner 100 comprises the combustion head TC. The combustion head TC is connected to the device 1 through the outlet 203. The combustion TC head is configured to allow the combustion of the oxidizer-gas mixture (air/gas). The burner comprises an ignition device 101. The ignition device 101 is configured to start the combustion in the combustion head TC.

According to an aspect of the invention, the invention also provides a method for controlling the fuel-oxidizer mixture in premix gas burners.

According to an embodiment, the method comprises a step of preparing a device 1 for controlling the fuel-oxidizer mixture in premix gas burners. The term "air" will be used below when referring to the oxidizer without wishing to limit the scope of protection to this type of oxidizer. Moreover, the term "fluid" will be used to refer without distinction to air or to the air-gas mixture. The method comprises a step of preparing one or more of the following elements: an intake duct 2, including an inlet 201, an outlet 203 and a mixing zone 202.

The method comprises a receiving step, wherein the air flows through the inlet 201, in contact with the outside environment, and reaches the intake duct 2 at the ambient pressure Pa.

The method comprises a delivery step, wherein the air-gas mixture is delivered to a combustion head TC through the outlet 203.

The method comprises a mixing step, wherein the air and the gas are mixed in the mixing zone 202, between the inlet 201 and the outlet 203, to allow an adequate mixing between the gas and the air.

According to an embodiment, an operating flow (which may be only air or an air-gas mixture, as a function of the position along the intake duct 2) passes through the intake duct in a direction of flow D and in an inflow direction V, oriented from the inlet 201 to the outlet 203.

According to an embodiment, the method comprises an injection step. In the initiation step, an injection duct 3, connected with the intake duct 2, injects gas in the intake duct 2. According to an embodiment, the gas is injected into the mixing zone 202. According to an embodiment, the gas is injected by an injection nozzle 301, facing the mixing zone and located at a first end of the injection duct 3.

The method comprises a supplying step, wherein a second end of the injection duct 3, opposite the injection nozzle 301 receives gas from a gas supplier, for example the gas network.

The method comprises a monitoring step, wherein a monitoring device 4 detects control signals 401 inside the combustion head TC, for determining the state of combustion inside the combustion head TC.

According to an embodiment, the method comprises a control step, wherein a control unit 5 controls the device 1 by regulating the air-gas mixture.

The control unit 5 receives the control signals 401 from the monitoring device 4. The control unit 5 receives input signals 601 from the user interface 6.

In the control step, the control unit 5 processes the control signals 401.

According to an embodiment, the control unit 5 processes the input signals 601.

The controlling step comprises a step of generating commands, wherein the control unit 5 generates drive signals 501, as a function of the control signals 401. According to an embodiment, the control unit 5 generates drive signals 501, as a function of input signals 601.

According to an embodiment, the method comprises a first regulation step, wherein the control unit 5 sends the drive signals 501 to a first regulator 7, positioned on the injection duct 3 and intercepting the flow of the gas in the injection duct 3.

The first regulation step comprises a step of varying the gas flow rate. In this step of varying the gas flow rate, a mobile element of the first regulator 7 varies its position as a function of the drive signals 501. In particular, the position of the movable element of the first regulator 7 varies the gas flow rate which flows into the mixing zone 202. This occurs because, with the variation of the position of the movable element, the head loss which a flow of gas in the injection duct 3 must overcome varies and with the increase of the head losses the flow of gas injected reduces.

In the first regulation step, the gas flow rate is independent of the air pressure in a position upstream of the mixing zone 202, but depends only on the control signals 401, representing the state of combustion.

According to an embodiment, the method comprises an actuation step, wherein a fan 8, located in the intake duct 2, rotates at a speed of rotation variable in a range delimited by a first limit rotation speed $v_{min}$ and a second limit rotation speed $v_{max}$, greater than the first limit rotation speed $v_{min}$.

The device 1 operates within a range of mixture flow rates between a first limit flow rate $Q_{min}$ and a second limit flow rate $Q_{max}$, greater than the first limit flow rate $Q_{min}$.

The actuation step comprises a first limit actuation step, wherein the fan 8 rotates at the first limit rotation speed $v_{min}$ and the device 1 operates at the first limit flow rate $Q_{min}$. The actuation step comprises a second limit actuation step, wherein the fan 8 rotates at the second limit rotation speed $v_{max}$ and the device 1 operates at the second limit flow rate $Q_{max}$.

In the actuation step, the fan 8 rotates about an axis of rotation parallel to the direction of flow D. In the actuation step, the fan 8 generates the operating flow inside the intake duct.

In the actuation step, the control unit 5 actuates the fan 8.

In the actuation step, the control unit 5 actuates the fan 8, as a function of the drive signals 501.

The fan 8 is configured to provide to the air (or to the mixture) an operating pressure which allows the fluid to reach the combustion head TC.

According to an embodiment, the method comprises a second regulation step, wherein a second regulator 9 of the device 1 varies a cross section S of the intake duct 2. According to an embodiment, the second regulation step may occur with the second regulator 9 positioned upstream of the fan 8 in the inflow direction V. According to another embodiment, the second regulation step may occur with the second regulator 9 located downstream of the fan 8 in the inflow direction V.

According to an embodiment, the second regulation step may occur with the second regulator 9 located upstream of the mixing zone 202 in the inflow direction V.

In the second regulation step, the second regulator 9 receives a thrust of a first pressure, applied by the fluid in a first position 91 of the intake duct 2 upstream of the second regulator 9. In the second regulation step, the second regulator 9 receives a thrust of a second pressure, applied by the fluid in a second position 92 of the intake duct 2 downstream of the second regulator 9. In the second regulation step, the second regulator 9 receives a thrust of a differential pressure, resulting from the difference between the first pressure and the second pressure.

According to a preferred embodiment, in the second regulation step a mechanical control regulator is used, which defines the second regulator 9. This definition means a regulator which responds to stimuli of a mechanical or fluid-dynamic nature and not to electrical pulses. However, this does not mean excluding the solution in which the second regulator 9 can be controlled by the control unit 5, by further drive signals 501.

According to an embodiment, in the second regulation step the second regulator 9 is controlled directly. In other words, the second regulator varies a relative operating configuration with the variation of a physical parameter, as a function of which the second regulator 9 is able to automatically vary its operating configuration. This definition describes a solution in which the regulator is configured to detect itself a variation of the physical parameter which determines a corresponding variation of its operating condition. What is expressed in this paragraph will be described in more detail below, when the forces to which the second regulator 9 is subjected are described. In this case, too, the intention is not to exclude an "indirect" regulator from the scope of protection, that is to say, which needs a controller to vary the relative operating condition. In fact, according to an embodiment, the control unit 5 controls the second regulator 9, as a function of the drive signals 501.

According to an embodiment, the second regulation step comprises a cross section variation step, wherein a shutter 901 of the second regulator 9 moves in a housing 902 of the second regulator and varies (produces a variation) the cross section S of the intake duct 2.

According to an embodiment, the cross section variation step is carried out by means of a housing 902 (preferably with a variable cross section along the direction of flow D) which contains a ball 901A, defining the shutter. According to an embodiment, in the second variation step, the housing 902 of the second regulator 9 executes a seal with the intake duct, in such a way as to avoid any flow leakages.

According to an embodiment, in the cross section variation step, the ball 901A moves inside the housing 902, between a first limit position 903 and a second limit position 904, for steplessly varying the cross section S. In the cross section variation step, when the ball 901A is in the first limit position the cross section S is equal to a first limit cross section S1, defined by a passage hole 901A' formed on the ball 901A. In other words, the ball 901A also allows the passage of fluid when it is in the first limit position 903, since the area of the passage hole 901A' is different from zero.

In the cross section variation step, when the ball 901A is in the second limit position the cross section S is equal to a second limit cross section S2.

According to an embodiment, in the cross section variation step, the ball 901A moves along a sliding direction D' parallel to the direction of flow D. In the cross section variation step, the ball 901A moves along the sliding direction D', which, on the other hand, is perpendicular to the direction of flow D.

According to an embodiment, the sliding direction D' is perpendicular to the direction of the weight force. According to another embodiment, the sliding direction D' is parallel to the direction of the weight force.

According to an embodiment, in the cross section variation step (of second regulation) the ball 901A touches the housing only in the first limit position 903 whilst in the other intermediate positions and in the second limit position 904 it is spaced from the walls 902A of the housing 902.

In the first limit position 903 the ball 901A rests on the housing 902, at its first end 902B. In this first limit position 903, a shoulder 902B' of the housing 902 supports the ball 901A in its first limit position 903.

According to an embodiment, in the cross section variation step, the ball 901A moves from a relative position in the housing by effect of a pressure variation which the fan 8 generates in the intake duct 2 downstream of the second regulator 9, that is to say, downstream of the ball 901A. The pressure variation which the fan 8 generates is due to a variation in the speed of rotation of the fan. In other words, the ball 901A moves due to the effect of a variation of the second pressure.

According to an embodiment, the method also comprises a hold step, wherein the ball undergoes the thrust of a hold pressure.

The hold pressure holds the ball 901A resting on the shoulder 902B' of the housing 902. The drawings show two types of hold pressure. According to an embodiment, the hold pressure is defined by the relative weight of the ball 901A, which keeps the ball 901A on the housing 902B'. According to another embodiment, the hold pressure is defined by an elastic force generated by a return spring 905, which pushes the ball towards the housing 902B'. The embodiments of the hold pressure described may obviously be coupled and redundant.

The description below will therefore consider the hold pressure to be dependent on the weight of the ball 901A without wishing to limit in any way the scope of protection.

Figure 5:
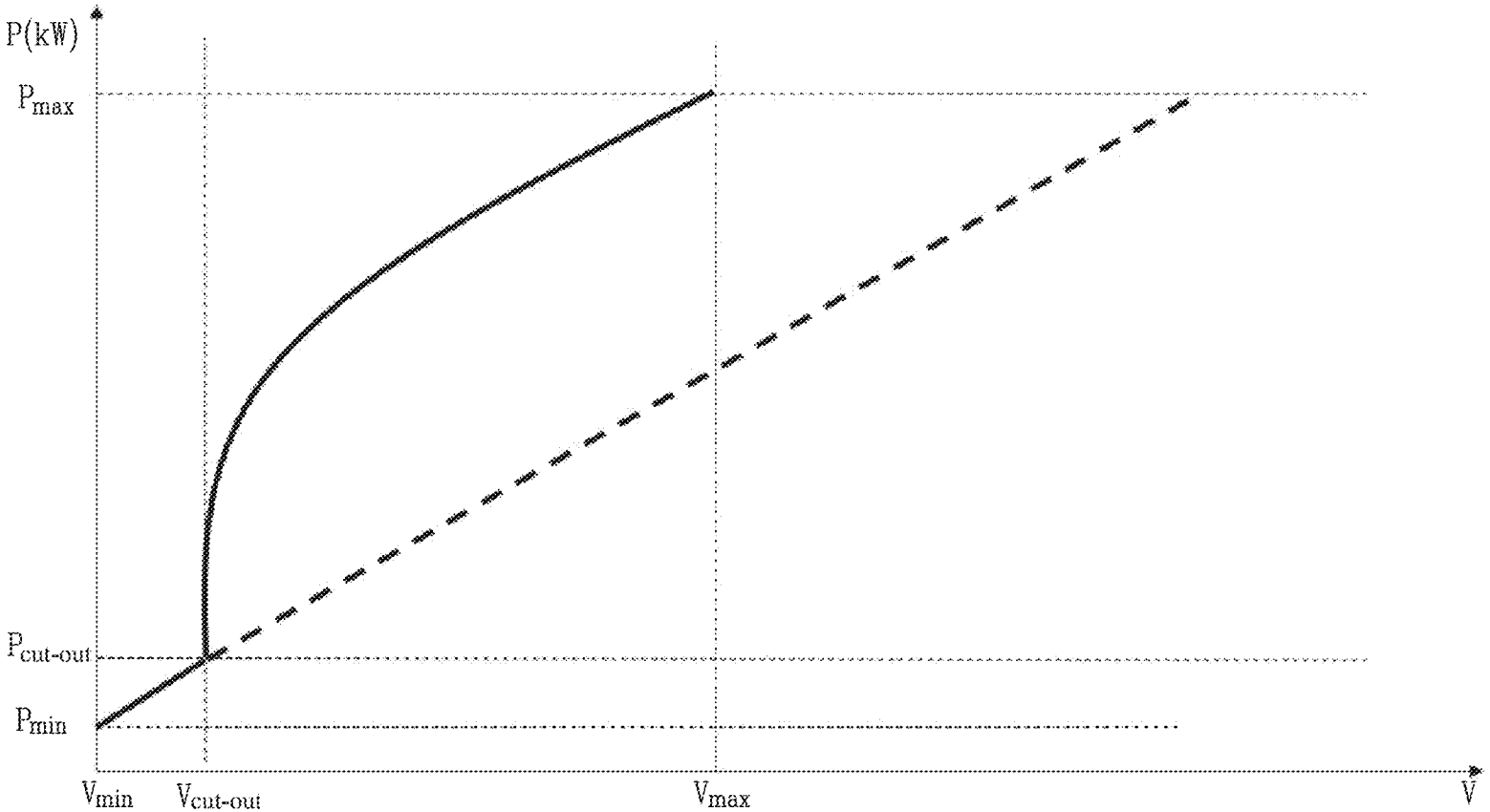
FIG. 5 illustrates the diagram of an operating pressure as a function of the rotation speed of a fan of the device of FIG. 1A.

According to an embodiment, the fan 8 rotates at a cut-out speed $v_{cut\text{-}out}$, between the first limit rotation speed $v_{min}$ and the second limit rotation speed $v_{max}$, as represented in FIG. 5, for example.

When the fan 8 rotates at the cut-out speed $v_{cut\text{-}out}$, the device 1 operates at a corresponding cut-out flow rate $Q_{cut\text{-}out}$, as shown in FIGS. 6A and 6B. According to an embodiment, the fan 8 generates a cut-out pressure $p_{cut\text{-}out}$. More precisely, the fan 8 generates a variation of the second pressure, up to a value equal to the cut-out pressure $p_{cut\text{-}out}$.

When the rotation speed of the fan 8 is equal to the cut-out speed $v_{cut\text{-}out}$ the second pressure exerted on the ball 901A is equal to the cut-out pressure.

The cut-out pressure $p_{cut\text{-}out}$ exceeds the hold pressure. In other words, the cut-out pressure $p_{cut\text{-}out}$ is the pressure immediately higher than the hold pressure, which, being in the opposite direction to the hold pressure, causes the detachment of the ball 901A from its housing 902.

According to an embodiment, the cut-out pressure $p_{cut\text{-}out}$ depends on the weight of the ball 901A. According to other embodiments, the cut-out pressure $p_{cut\text{-}out}$ depends on the elastic force of the return spring 905 or, if necessary, a friction force.

According to an embodiment, the ball 901A starts to move in the sliding direction D' when the fan 8 rotates at the cut-out speed $v_{cut\text{-}out}$.

According to an embodiment, the second regulation step is a variable cross section regulation. According to an embodiment, the second regulation step is a constant cross section regulation.

In the second regulation step, the second regulator may be in a first operating configuration, with a cross section S constant over time, when the rotation speed of the fan is included in a first range of rotation speeds of the fan 8 between the first limit rotation speed $v_{min}$ and the cut-out speed $v_{cut\text{-}out}$.

In the second regulation step, the second regulator may be in a second operating configuration, with a cross section S variable over time, when the rotation speed of the fan is included in a second range of rotation speeds of the fan 8 between the cut-out speed $v_{cut\text{-}out}$ and the first limit rotation speed $v_{min}$.

According to an embodiment, in the first operating configuration, the ball 901A remains resting on the shoulder 902B' of the housing 902. According to an embodiment, in the first operating configuration, the hold pressure exceeds the differential pressure.

According to an embodiment, in the second operating configuration, the ball 901A rises when the operating flow rate Q rises, increasing consequently the cross section S. According to an embodiment, in the second operating configuration, the ball 901A lowers the flow rate Q, reducing consequently the cross section S.

According to an embodiment, in the first operating configuration, the differential pressure exceeds the hold pressure.

In the first operating configuration, the second regulator 9 increases the head losses through the second regulator 9 with the increase in the flow rate Q (increasing the differential pressure applied to the ball 901A). In the second operating configuration, the second regulator 9 ideally keeps constant the head losses through the second regulator 9 (keeping the differential pressure applied to the ball 901A constant). The term ideally refers to the fact that due to the complexity of the problem it is very unlikely that the head losses remain constant. There is, however, a very low rate of increase, which is approximately constant.

According to an embodiment, the second regulator 9 regulates the flow rate of fluid (air or mixture) using the physical principle of the "Asameter ®".

According to an aspect of the invention, the invention also intends to protect a method for regulating a premix gas burner 100 comprising one or more of the steps of the method described in the invention. The method comprises a combustion step, wherein the combustion head TC maintains the conditions for a combustion of the oxidizer-gas mixture (air/gas). The method comprises an ignition step, wherein an ignition device 101 starts the combustion inside the combustion head TC.

What is claimed is:

1. A device for controlling a fuel-oxidizer mixture for a premix gas burner, comprising:

an intake duct, which defines a cross section for the admission of a fluid into the duct and includes an inlet for receiving the oxidizer, a mixing zone for receiving the fuel and allowing it to be mixed with the oxidizer, and an outlet for delivering the mixture to the burner;

an injection duct, connected to the intake duct in the mixing zone to supply the fuel;

a monitoring device that generates a control signal representing a state of combustion in the burner;

a gas regulating valve, located along the injection duct;

a fan, rotating at a variable speed of rotation and located in the intake duct to generate therein a workflow in a direction of inflow oriented from the inlet to the delivery outlet;

a control unit that controls the speed of rotation of the fan;

a regulator coupled to the intake duct to vary its cross section as a function of the speed of rotation of the fan, the regulator comprising a ball and a tapered duct whose cross section increases in size in the direction of inflow, and wherein the ball is movable in the tapered duct along a sliding direction, perpendicular to the cross section of the intake duct and parallel to the direction of the weight force, wherien the control unit receives the control signal and generates a drive signal representing a fuel flow rate as a function of the control signal to drive the gas regulating valve in real time.

2. The device according to claim 1, wherein the regulator varies the cross section of the intake duct steplessly from a first limit cross section to a second limit cross section.

3. The device according to claim 1, wherein the regulator is a mechanically controlled regulator, including a shutter and a housing, and wherein the shutter is movable relative to the housing to vary the cross section of the intake duct.

4. The device according to claim 3, wherein the shutter is movable between a first limit position, corresponding to a first limit cross section, different from zero, and a second limit position, corresponding to a second limit cross section and wherein the first limit cross section is smaller than the second limit cross section.

5. The device according to claim 3, wherein the shutter moves relative to the housing by effect of a pressure variation produced by the fan in the intake duct downstream of the shutter.

6. The device according to claim 3, wherein the fan produces on the shutter a cut-out pressure ($P_{cut\text{-}out}$) at a corresponding cut-out speed ($v_{cut\text{-}out}$) and wherein the shutter is subject to a hold pressure which is less than, and directed in the direction opposite to, the cut-out pressure ($P_{cut\text{-}out}$).

7. The device according to claim 6, wherein the hold pressure and the cut-out speed ($v_{cut\text{-}out}$) depend on the weight of the shutter.

8. The device according to claim 1, wherein the regulator and the cross section of the intake duct are located upstream of the mixing zone in the direction of inflow.

9. The device according to claim 1, wherein the regulator includes a flowmeter.

10. A premix burner comprising:

a device for controlling a fuel-oxidizer mixture according to claim 1;

a combustion head connected to the device through the delivery outlet; and an ignition device that starts combustion in the combustion head.

11. A method for controlling the fuel-oxidizer mixture in a premix gas burner, the method comprising:

admitting oxidizer into an intake duct through an inlet;

delivering fuel-oxidizer mixture through a delivery outlet;

mixing oxidizer and fuel in a mixing zone;

feeding fuel to the mixing zone through an injection duct connected to the intake duct;

monitoring the combustion in the burner and generating control signals through a monitoring device;

generating a drive signal through a control unit as a function of the control signals;

varying a fuel flow rate through a gas regulating valve located along the injection duct;

operating a fan at a variable speed of rotation and generating a flow in the intake duct in a direction of inflow oriented from the inlet to the delivery outlet;

varying a cross section which admits a fluid into the intake duct as a function of the speed of rotation of the fan through a regulator coupled to the intake duct, the regulator comprising a ball and a tapered duct whose cross section increases in size in the direction of inflow, and wherein the ball is movable in the tapered duct along a sliding direction, perpendicular to the cross section of the intake duct and parallel to the direction of the weight force, wherein varying the fuel flow rate comprises: with the control unit, receiving the control signal and generating the drive signal representing a fuel flow rate as a function of the control signal to drive the gas regulating valve in real time.

12. The method according to claim 11, wherein varying the cross section of the intake duct comprises steplessly varying the cross section between a first limit cross section and a second limit cross section.

13. The method according to claim 11, wherein varying the cross section of the intake duct comprises: moving a shutter of the regulator by varying a pressure in the intake duct as a result of a respective variation of the speed of rotation of the fan.

14. The method according to claim 11, wherein varying the cross section of the intake duct comprises: moving a shutter of the second regulator from a first limit position, corresponding to a first limit cross section, different from zero, to a second limit position, corresponding to a second limit cross section, and wherein the first limit cross section is smaller than the second limit cross section.

15. The method according to claim 14, wherein the shutter is held at the first limit position by a hold pressure and wherein varying the cross section of the intake duct comprises: performing a cut out during which the fan produces on the shutter a cut-out pressure ($p_{cut\text{-}out}$), corresponding to a respective cut-out speed ($v_{cut\text{-}out}$) and which is greater than and directed in the direction opposite to, the hold pressure, thereby moving the shutter away from the first limit position.

16. The method according to claim 15, wherein the shutter moves along a direction parallel to the direction of the weight force and wherein the hold pressure is produced by the weight of the shutter.

17. A device for controlling a fuel-oxidizer mixture for a premix gas burner, comprising:

an intake duct, which defines a cross section for the admission of a fluid into the duct and includes an inlet for receiving the oxidizer, a mixing zone for receiving the fuel and allowing it to be mixed with the oxidizer, and an outlet for delivering the mixture to the burner;

an injection duct, connected to the intake duct in the mixing zone to supply the fuel;

a monitoring device that generates a control signal representing a state of combustion in the burner;

a gas regulating valve, located along the injection duct;

a fan, rotating at a variable speed of rotation and located in the intake duct to generate therein a workflow in a direction of inflow oriented from the inlet to the delivery outlet;

a control unit that controls the speed of rotation of the fan;

a regulator coupled to the intake duct to vary its cross section as a function of the speed of rotation of the fan, wherien the control unit receives the control signal and generates a drive signal representing a fuel flow rate as a function of the control signal to drive the gas regulating valve in real time, wherein the regulator is a mechanically controlled regulator, including a shutter and a housing, and wherein the shutter is movable relative to the housing to vary the cross section of the intake duct, wherein the regulator and the cross section of the intake duct are located upstream of the mixing zone in the direction of inflow.

18. A device for controlling a fuel-oxidizer mixture for a premix gas burner, comprising:

an intake duct, which defines a cross section for the admission of a fluid into the duct and includes an inlet for receiving the oxidizer, a mixing zone for receiving the fuel and allowing it to be mixed with the oxidizer, and an outlet for delivering the mixture to the burner;

an injection duct, connected to the intake duct in the mixing zone to supply the fuel;

a monitoring device that generates a control signal representing a state of combustion in the burner;

a gas regulating valve, located along the injection duct;

a fan, rotating at a variable speed of rotation and located in the intake duct to generate therein a workflow in a direction of inflow oriented from the inlet to the delivery outlet;

a control unit that controls the speed of rotation of the fan;

a regulator coupled to the intake duct to vary its cross section as a function of the speed of rotation of the fan, wherien the control unit receives the control signal and generates a drive signal representing a fuel flow rate as a function of the control signal to drive the gas regulating valve in real time, wherein the regulator is a mechanically controlled regulator, including a shutter and a housing, and wherein the shutter is movable relative to the housing to vary the cross section of the intake duct, wherein the shutter is movable between a first limit position, corresponding to a first limit cross section, different from zero, and a second limit position, corresponding to a second limit cross section and wherein the first limit cross section is smaller than the second limit cross section, wherein the shutter is in contact with the housing solely in the first limit position.

19. The device according to claim 18, wherein the shutter moves by translation along the direction of inflow oriented from the inlet to the delivery outlet.

* * * * *